US008818236B2

(12) United States Patent
Takashima

(10) Patent No.: US 8,818,236 B2
(45) Date of Patent: Aug. 26, 2014

(54) DEVELOPER TRANSPORTING DEVICE AND IMAGE FORMING APPARATUS

(75) Inventor: Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 138 days.

(21) Appl. No.: 13/469,195

(22) Filed: May 11, 2012

(65) Prior Publication Data

US 2013/0121732 A1 May 16, 2013

(30) Foreign Application Priority Data

Nov. 16, 2011 (JP) ..... 2011-250309

(51) Int. Cl.
*G03G 21/18* (2006.01)

(52) U.S. Cl.
USPC ..... 399/114; 399/258

(58) Field of Classification Search
USPC ..... 399/114, 258
See application file for complete search history.

(56) References Cited

FOREIGN PATENT DOCUMENTS

JP 2005-134452 A 5/2005
JP 2008-129357 A 6/2008

*Primary Examiner* — Walter L Lindsay, Jr.
*Assistant Examiner* — Barnabas Fekete
(74) *Attorney, Agent, or Firm* — Sughrue Mion, PLLC

(57) ABSTRACT

A developer transporting device includes a transporting device body including a transporting portion having an inlet, a developer container including a container portion having an outlet connected to the inlet and a cover member that is movable between positions for opening and closing the outlet, a first contact portion supported by the cover member, a guide portion including a passage portion and an inclined portion that is connected to the passage portion and that comes into contact with the first contact portion to move the cover member, and a second contact portion that is provided on the passage portion and extends toward the position for closing the outlet. The second contact portion comes into contact with the first contact portion and moves the cover member toward the position for closing the outlet when the first contact portion passes the second contact portion.

10 Claims, 14 Drawing Sheets

DEVELOPER TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2011-250309 filed Nov. 16, 2011.

BACKGROUND (i) Technical Field

The present invention relates to a developer transporting device and an image forming apparatus.

(ii) Related Art

An example of an electrophotographic image forming apparatus includes a container that contains developer to be supplied and consumed in an image forming operation and a container into which developer discharged in the image forming operation is collected. The containers are generally replaceable and are detachably attached to the image forming apparatus.

SUMMARY

According to an aspect of the invention, there is provided a developer transporting device including a transporting device body, a developer container, a first contact portion, a guide portion, and a second contact portion. The transporting device body includes a transporting portion through which developer is transported, the transporting portion having an inlet that allows the developer to be supplied therethrough. The developer container is detachably supported on the transporting device body and includes a container portion and a cover member, the container portion containing developer and having an outlet that is connectable to the inlet and through which the developer is discharged from the container portion, and the cover member being movable between an uncovering position for uncovering the outlet and a covering position for covering the outlet in a moving direction that crosses an attachment direction in which the developer container is attached to the transporting device body. The first contact portion is supported by the cover member. The guide portion is provided on the transporting device body, allows the first contact portion to pass therethrough, and includes a passage portion and an inclined portion, the passage portion extending in the attachment direction, the inclined portion being connected to a downstream end of the passage portion in the attachment direction and inclined away from the outlet, the inclined portion contacting with the first contact portion and moving the cover member in the moving direction. The second contact portion is provided on the passage portion, contacts with the first contact portion, and moves the cover member toward the covering position when the first contact portion passes the second contact portion.

BRIEF DESCRIPTION OF THE DRAWINGS

An exemplary embodiment of the present invention will be described in detail based on the following figures, wherein:

FIGS. 11A and 11B illustrate the states of the body shutter, a supply-hole/shutter lock member, the cartridge inner shutter, the shutter support, and a cartridge engagement member according to the exemplary embodiment, wherein FIG. 11A illustrates the state in which the cartridge is separated from the body and FIG. 11B illustrates the state in which the cartridge is inserted from the state illustrated in FIG. 11A to the state in which the cartridge inner shutter is in contact with locking arms;

FIGS. 12A and 12B illustrate the states after the states in FIGS. 11A and 11B, wherein FIG. 12A illustrates the state in which the cartridge is further inserted from the state illustrated in FIG. 11B and the cartridge engagement member is in contact with a body engagement member and FIG. 12B illustrates the state in which the cartridge is further inserted from the state illustrated in FIG. 12A and the cartridge engagement member is placed in the body engagement member;

FIGS. 13A and 13B illustrate the states after the states in FIGS. 12A and 12B, wherein FIG. 13A illustrates the state in which the cartridge is further inserted from the state illustrated in FIG. 12B and the insertion of the cartridge is completed, and FIG. 13B illustrates the state in which the cartridge is pulled outward from the state illustrated in FIG. 13A and deformation of the body engagement member is suppressed;

DETAILED DESCRIPTION

An exemplary embodiment of the present invention will be described with reference to the drawings. However, the present invention is not limited to the following exemplary embodiment.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

Figure 1:
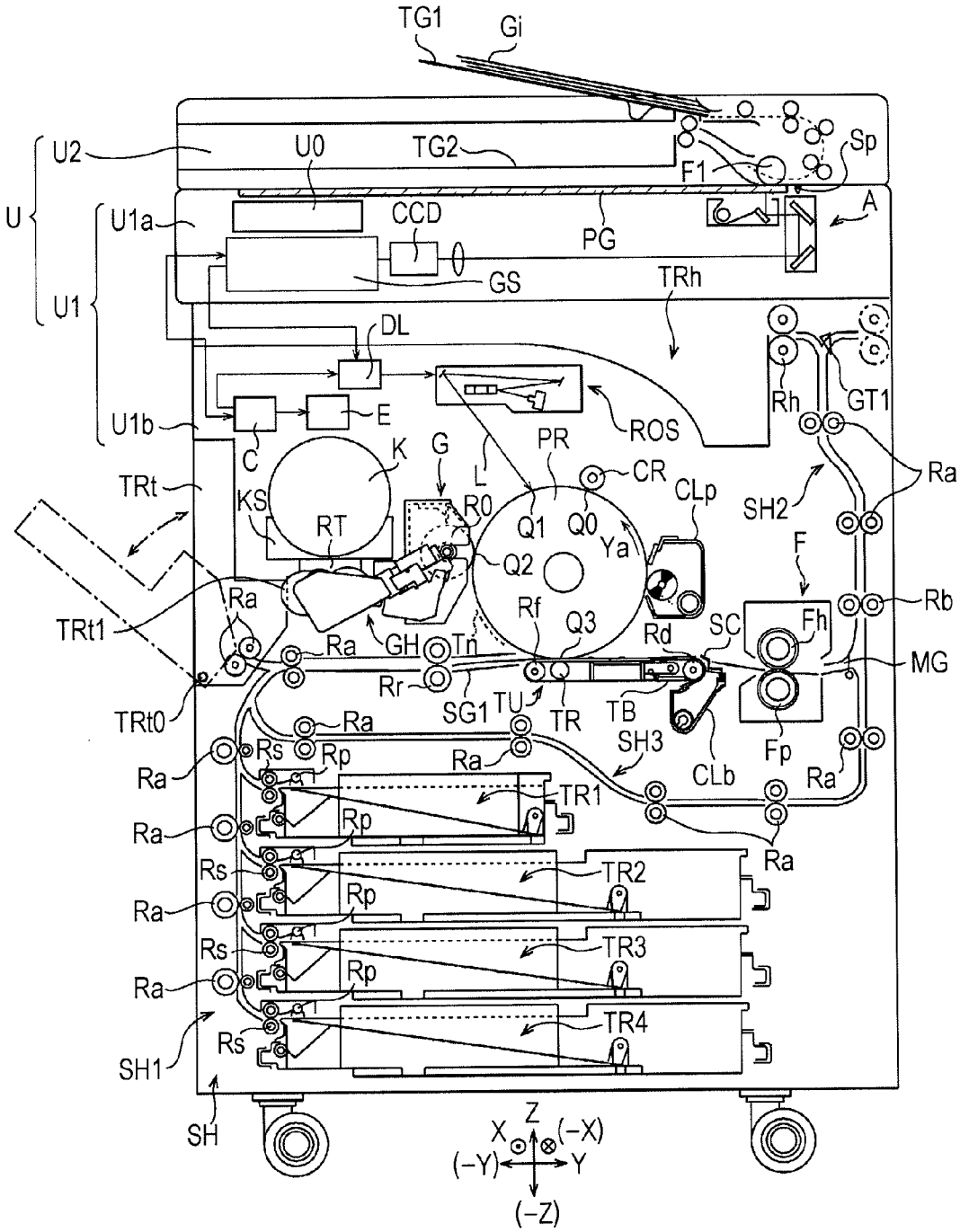
FIG. 1 illustrates an image forming apparatus including a developer transporting device according to an exemplary embodiment of the present invention.

FIG. 1 illustrates an image forming apparatus including a developer transporting device according to an exemplary embodiment of the present invention.

Referring to FIG. 1, a copy machine U is an example of the image forming apparatus according to the present exemplary embodiment. The copy machine U includes a copy machine body U1 as an example of a body of the image forming apparatus. The copy machine body U1 includes a transparent platen glass PG, which is an example of an original document table, at the top surface thereof. An document transport device U2, which is an example of an additional device, is detachably supported on the platen glass PG.

The document transport device U2 includes an original document tray TG1 as an example of an original-document receiver. Sheets of original document Gi of which a copy is to be made are stacked on the original document tray TG1. The sheets of original document Gi placed on the original document tray TG1 are successively transported to a copy position on the platen glass PG, and are ejected to an original-document output tray TG2, which is an example of an original-document output unit.

The copy machine body U1 includes a scanner unit U1*a*, which is an example of an image reading unit, and a printer unit U1*b*, which is an example of an image recording unit. The scanner unit U1*a* includes an input unit U0 used by an operator who performs an input operation and the platen glass PG at the top surface thereof. In the present exemplary embodiment, the scanner unit U1*a* is provided with an image processor GS.

The scanner unit U1*a* includes an exposure registration sensor Sp and an exposure optical system A. The exposure registration sensor Sp is an example of a position detection member of an exposure system, and is arranged at an original-document reading position.

The exposure optical system A is moved or stopped under the control based on a detection signal from the exposure registration sensor Sp. In a steady state, the exposure optical system A is stopped at an initial position, that is, a home position, which is an example of an image reading position.

An automatic reading operation is performed to make a copy of the original document Gi by automatically transporting the sheets of original document Gi by using the document transport device U2. In this operation, the sheets of original document Gi that successively pass the copy position F1 on the platen glass PG are exposed to light from the exposure optical system A while the exposure optical system A is stopped at the home position.

A manual reading operation is performed when a user manually places each sheet of original document Gi on the platen glass PG to make a copy of the original document Gi. In this operation, each sheet of original document Gi placed on the platen glass PG is exposed to light from the exposure optical system A while the exposure optical system A is moving.

The light is reflected by the sheet of original document Gi, passes through the exposure optical system A, and is focused on a solid-state imaging device CCD, which is an example of an imaging element. The solid-state imaging device CCD converts the light reflected by the sheet of original document Gi and focused on an imaging surface of the solid-state imaging device CCD into an electrical signal.

The image processor GS receives a read image signal from the CCD in the scanner unit U1*a*, converts the received signal into a digital image write signal, and outputs the image write signal to an image write circuit DL included in the printer unit U1*b*.

The image write circuit DL receives the image write signal, generates a drive signal for forming a latent image that corresponds to the image write signal, and outputs the drive signal to an exposure device ROS, which is an example of a latent-image forming device.

A photoconductor drum PR, which is an example of an image carrier, is disposed below the exposure device ROS. The photoconductor drum PR rotates in the direction shown by arrow Ya. The surface of the photoconductor drum PR is charged by a charging roller CR, which is an example of a charging device, in a charging area Q0. Then, the surface of the photoconductor drum PR is exposed to and scanned with a laser beam L, which is an example of latent-image writing light emitted from the exposure device ROS, at a latent-image writing position Q1. Thus, a latent image is formed. The surface of the photoconductor drum PR on which the latent image is formed is moved as the photoconductor drum PR rotates, and successively passes through a developing area Q2 and a transfer area Q3.

A developing device G is opposed to the photoconductor drum PR in the developing area Q2. The developing device G includes a developing roller R0, which is an example of a developer carrier, for transporting the developer to the developing area Q2. The developing device G forms a toner image, which is an example of a visible image, by developing the electrostatic latent image that passes through the developing area Q2.

A cartridge K, which is an example of a developer container for supplying the developer to be consumed by the developing device G, is disposed on the left side of the developing device G. The cartridge K is detachably attached to a cartridge holder KS, which is an example of a container holder. The developer contained in the cartridge K is transported while being stirred in a reservoir tank RT, which is an example of a temporal reservoir, and is supplied to the developing device G by a transporting system GH that is connected to the reservoir tank RT.

Paper feed trays TR1 to TR4, which are examples of medium storage units, are detachably supported in an area below the copy machine body U1. Recording sheets S, which are examples of media, are stored in the paper feed trays TR1 to TR4.

The sheets S on the trays TR1 to TR4 are fed by pick-up rollers Rp, which are examples of pick-up members, at a predetermined paper-feed time, and are separated from each other by separation rollers Rs, which are examples of separation members. Then, each sheet S is transported by plural transport rollers Ra, which are examples of medium transport members, to registration rollers Rr, which are examples of feeding members.

A manual feed tray TRt, which is an example of a manual feed unit, is disposed on the left side of the cartridge holder KS and the reservoir tank RT. Sheets S fed from the manual feed tray TRt are also transported to the registration rollers Rr. The manual feed tray TRt according to the present exemplary embodiment is supported such that the manual feed tray TRt is rotatable around a rotational center TRt0. When the manual feed tray TRt is placed in the image forming apparatus U, as shown by the solid lines in FIG. 1, a part TRt1 of the manual feed tray TRt that is near the rotational center TRt0 thereof is located in a space below the cartridge holder KS and on the left side of the reservoir tank RT. Thus, the manual feed tray TRt is space-efficiently arranged manner and the overall size of the copy machine U is reduced.

Each sheet S that has been transported to the registration rollers Rr is transported from a pre-transfer sheet guide SG1, which is an example of a pre-transfer guiding member, to the transfer area Q3 in synchronization with the time at which the toner image on the surface of the photoconductor drum PR is moved to the transfer area Q3.

A transfer unit TU, which is an example of a transfer device or a transfer-transport device, is opposed to the photoconductor drum PR in the transfer area Q3. The transfer unit TU includes a transfer-transport belt TB, which is an example of a medium transporting member. The transfer-transport belt TB supports the recording sheet S that has been transported to the transfer area Q3 on the surface thereof, and transports the recording sheet S. The transfer-transport belt TB is rotatably supported by belt support rollers Rd+Rf, which are examples of medium-transporting-member support units. The belt support rollers include Rd+Rf a driving roller Rd, which is an example of a driving member, and a driven roller Rf, which is an example of a driven member. A transfer roller TR, which is an example of a transfer member, is opposed to the photoconductor drum PR with the transfer-transport belt TB disposed therebetween.

A transfer voltage is applied to the transfer roller TR by a power supply circuit E controlled by a controller C, which is an example of a control unit. Accordingly, a toner image Tn on the surface of the photoconductor drum PR is transferred onto the recording sheet S that passes through the transfer area Q3.

After the transfer process, residual toner that remains on the surface of the photoconductor drum PR is removed by a photoconductor cleaner CLp, which is an example of an image-carrier cleaner. Then, the surface of the photoconductor drum PR is charged again by the charging roller CR.

A separating claw SC, which is an example of a medium-separating member, is opposed to the driving roller Rd with the transfer-transport belt TB interposed therebetween. The sheet S onto which the toner image has been transferred by the transfer roller TR in the transfer area Q3 is separated from the surface of the transfer-transport belt TB by the separating claw SC at a position downstream of the transfer area Q3.

A belt cleaner CLb, which is an example of a medium-transporting-member cleaner, is disposed downstream of the separating claw SC in the rotational direction of the transfer-transport belt TB. The belt cleaner CLb removes the developer, paper dust, etc., from the surface of the transfer-transport belt TB after the recording sheet S is separated therefrom.

The separated sheet S is transported to a fixing device F which includes a heating roller Fh, which is an example of a heat-fixing member, and a pressing roller Fp, which is an example of a pressure-fixing member. The fixing device F fixes the toner image to the sheet S by applying heat and pressure. The sheet S to which the toner image has been fixed passes through a first gate MG, which is an example of a switch member made of an elastic material, while elastically deforming the first gate MG. Then, the recording sheet S is transported to transport rollers Rb, which are rotatable in both normal and reverse directions, on a sheet ejection path SH2, which is an example of a medium ejection path.

The sheet S is transported along the sheet ejection path SH2 on which the transport rollers Rb that are rotatable in both normal and reverse directions and plural transport rollers Ra are arranged, and is ejected to a paper output tray TRh. A second gate GT1, which is an example of a switch member, is disposed at the downstream end of the sheet ejection path SH2. In the case where a post-processing device (not shown) is connected to the copy machine U, the second gate GT1 selectively ejects the sheet S to either the paper output tray TRh, which is an example of a medium output unit, or the post-processing device (not shown). In the case where no post-processing device is connected, the second gate GT1 ejects the sheet S that has been transported to the downstream end of the sheet ejection path SH2 to the paper output tray TRh.

In the case where duplex printing is performed, when the sheet S having an image formed on one side thereof is transported to the transport rollers Rb that are rotatable in both normal and reverse directions, the transport rollers Rb start to rotate in the reverse direction before the trailing edge of the recording sheet S passes the transport rollers Rb. Accordingly, the sheet S is transported backward in a so-called switchback manner in the sheet ejection path SH2. The first gate MG guides the sheet S that has been transported backward by the transport rollers Rb in the switchback manner toward a circulation transport path SH3, which is an example of a circulation path. The sheet S that has been transported to the circulation transport path SH3 is transported to the transfer area Q3 again in a reversed manner. Thus, the sheet S having an image formed on a first side thereof is transported to the transfer area Q3 again, and a toner image is transferred onto a second side of the recording sheet S.

A medium transporting device SH according to the present exemplary embodiment includes the above-described components denoted by SH1 to SH3, Rp, Rs, Rr, Ra, Rb, and MG.

Description of Developer Transporting Device

Figure 2:
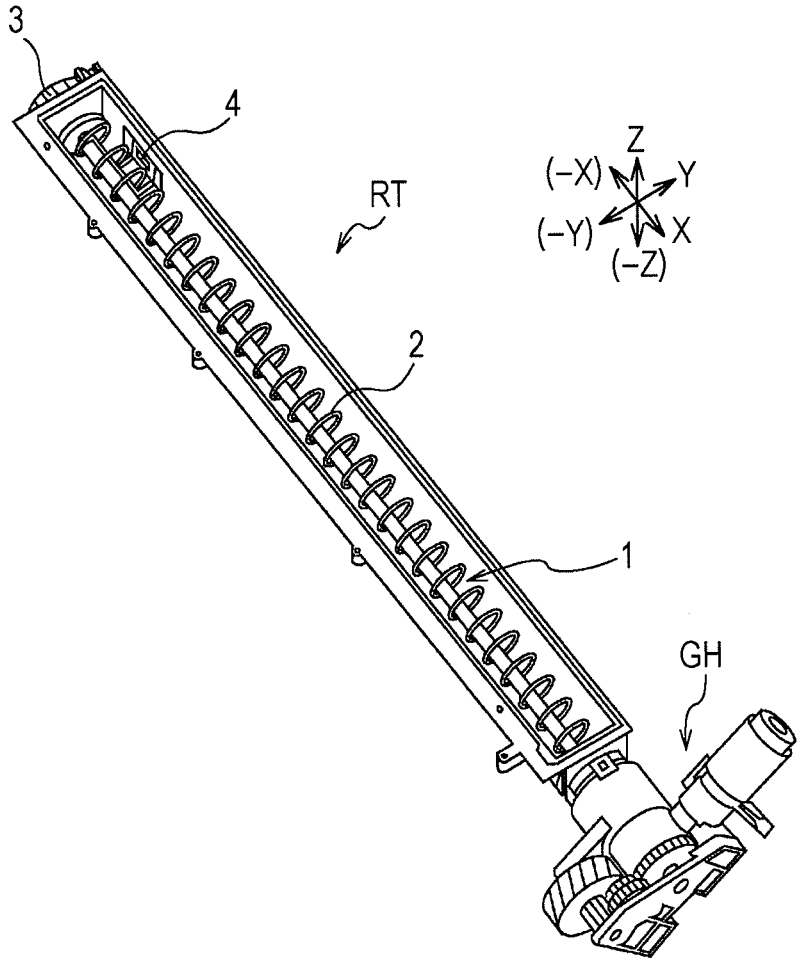
FIG. 2 illustrates a reservoir tank according to the exemplary embodiment.

FIG. 2 illustrates the reservoir tank RT according to the present exemplary embodiment.

Referring to FIG. 2, the reservoir tank RT according to the present exemplary embodiment includes a tank body 1 as an example of a transporting unit. The tank body 1 extends in the front-back direction and contains the developer therein. A supplying auger 2, which is an example of a transporting member, is rotatably supported in the tank body 1 such that the supplying auger 2 extends in the front-back direction. A gear 3, which is an example of a rotation-transmitting member, is supported at the back end of the supplying auger 2. Rotation of a drive source (not shown) is transmitted to the gear 3. Accordingly, the developer in the tank body 1 is transported in the direction from back to front. An empty-state detection sensor 4, which is an example of a detection member, is provided on a side wall of the tank body 1 at the back end thereof. The empty-state detection sensor 4 determines whether or not the cartridge K is empty by detecting the developer that flows into the tank body 1.

The transporting system GH is provided at the front end of the tank body 1. The transporting system GH transports the developer that has been transported to the front end of the tank body 1 by the supplying auger 2 to the developing device G. The transporting system GH is commonly known, and a system described in Japanese Unexamined Patent Application Publication No. 2008-129357, for example, may be used. Various types of transporting systems may be used as the transporting system GH, and detailed explanations thereof are thus omitted.

Figure 3:
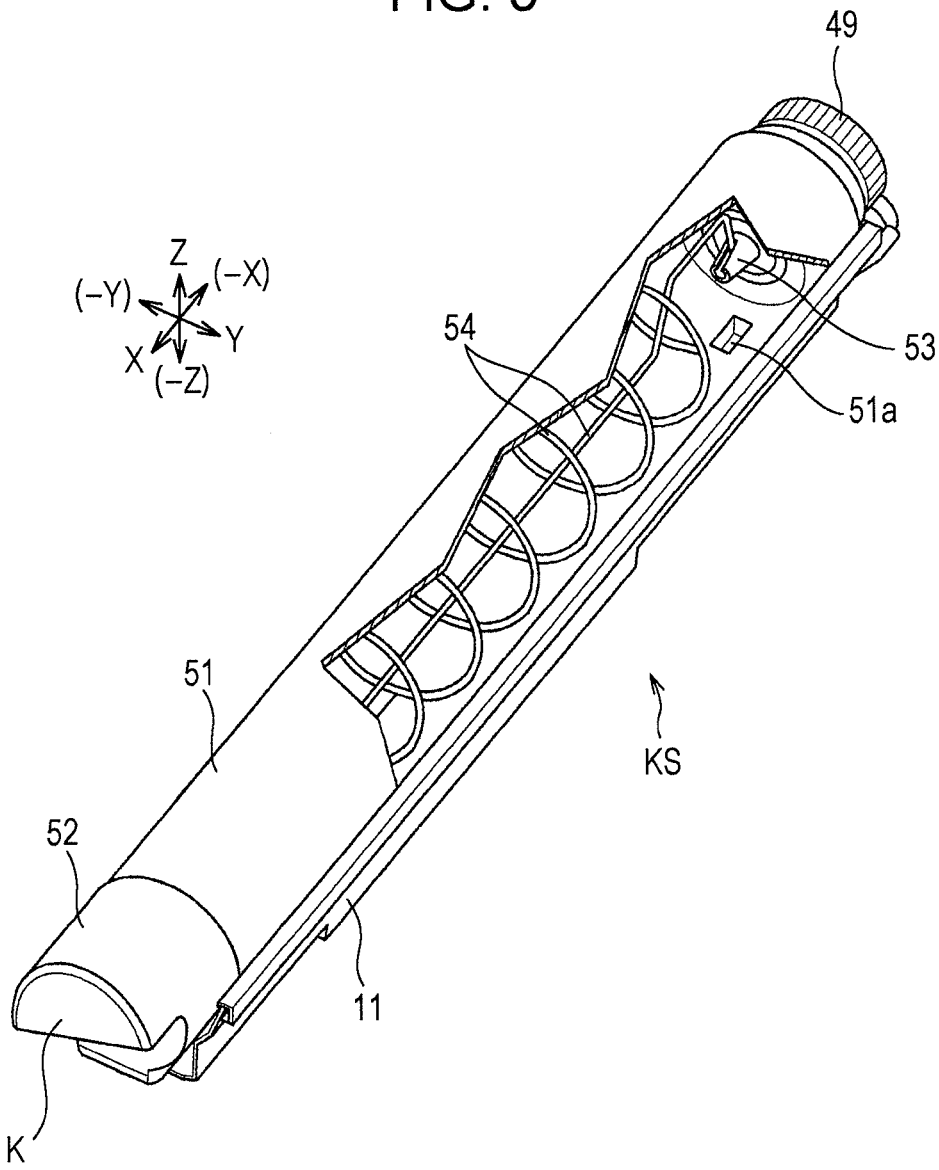
FIG. 3 is a perspective view illustrating the state in which a toner cartridge is attached to a cartridge holder according to the exemplary embodiment.

FIG. 3 is a perspective view illustrating the state in which the toner cartridge K is attached to the cartridge holder KS according to the present exemplary embodiment.

Figure 4A:
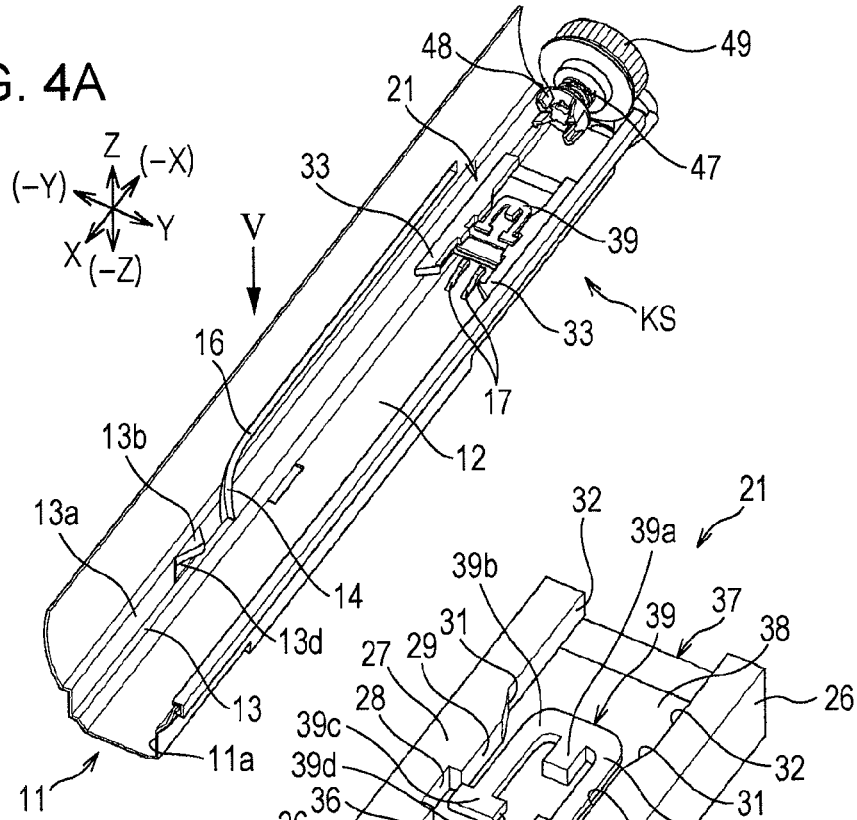
FIG. 4A illustrates the state in which the toner cartridge illustrated in FIG. 3 is removed from the cartridge holder.
Figure 4B:
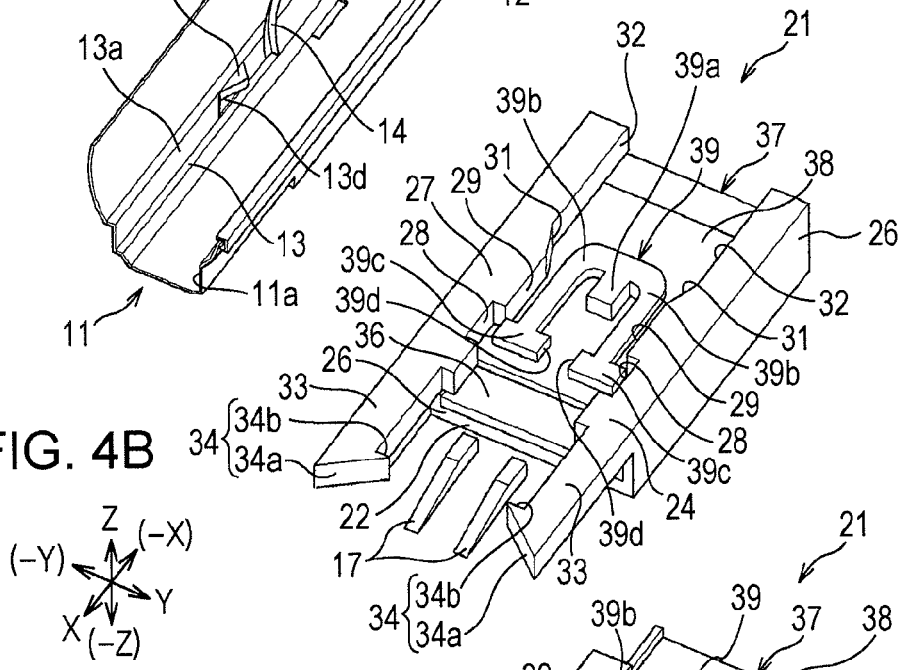
FIG. 4B illustrates a part of the cartridge holder in the state in which a body shutter is at a closed position.
Figure 4C:
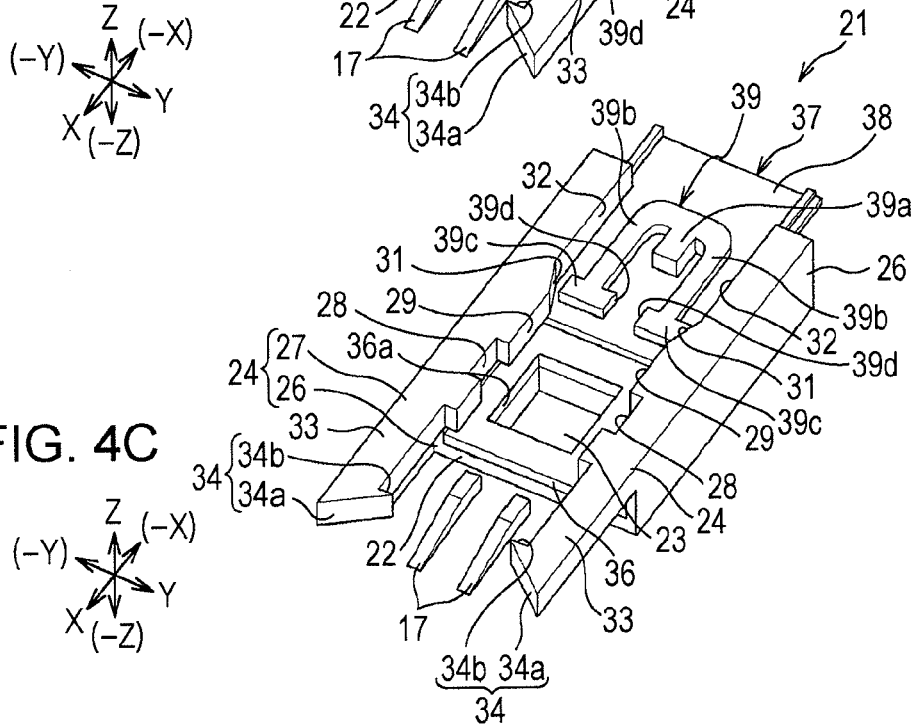
FIG. 4C illustrates the part of the cartridge holder in the state in which the body shutter is at an open position.

FIG. 4A illustrates the state in which the toner cartridge K illustrated in FIG. 3 is removed from the cartridge holder KS. FIG. 4B illustrates a part of the cartridge holder KS in the state in which a body shutter 37 is at a closed position. FIG. 4C illustrates the part of the cartridge holder KS in the state in which the body shutter 37 is at an open position.

Referring to FIGS. 1, 3, and 4A, the cartridge holder KS is supported above the reservoir tank RT, and includes a holder body 11, which is an example of the body of a container support member. The holder body 11 extends in the front-back direction. The holder body 11 has a substantially cylindrical inner peripheral surface, and a shutter passage 12, which is an example of a cover member passage, is formed at the bottom of the holder body 11. The shutter passage 12 is recessed downward and extends in the front-back direction.

Referring to FIG. 4A, a step-shaped projection passage 13, which is an example of a first contact-portion passage, is formed in the upper left area of the shutter passage 12 so as to extend in the front-back direction, which is the direction in which the cartridge K is attached to or detached from the cartridge holder KS. A helical guide groove 14, which is an example of an inclined portion and which is also an example of a guide portion for a contact portion, is provided behind the projection passage 13. The helical guide groove 14 is formed as a helical recessed portion that extends from a central position of the holder body 11 in the front-back direction toward the upper left and back along the inner peripheral surface of the holder body 11. A back guide groove 16, which is an example of a second contact-portion passage, is formed so as to extend continuously from the top end of the helical guide groove 14. The back guide groove 16 is formed as a recessed portion that extends backward.

Referring to FIGS. 4A to 4C, plural rattling preventing ribs 17, which are examples of rattling preventing portions, are formed in a back area of the shutter passage 12. The rattling preventing ribs 17 are inclined upward toward the back.

Figure 5:
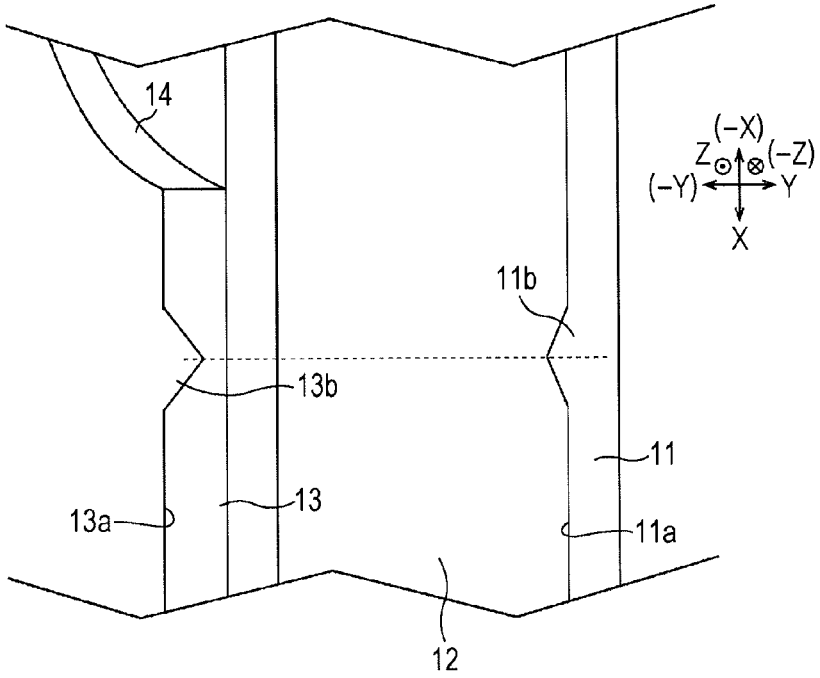
FIG. 5 illustrates the structure of FIG. 4A viewed in the direction of arrow V.

FIG. 5 illustrates the structure of FIG. 4A viewed in the direction of arrow V.

Figure 6:
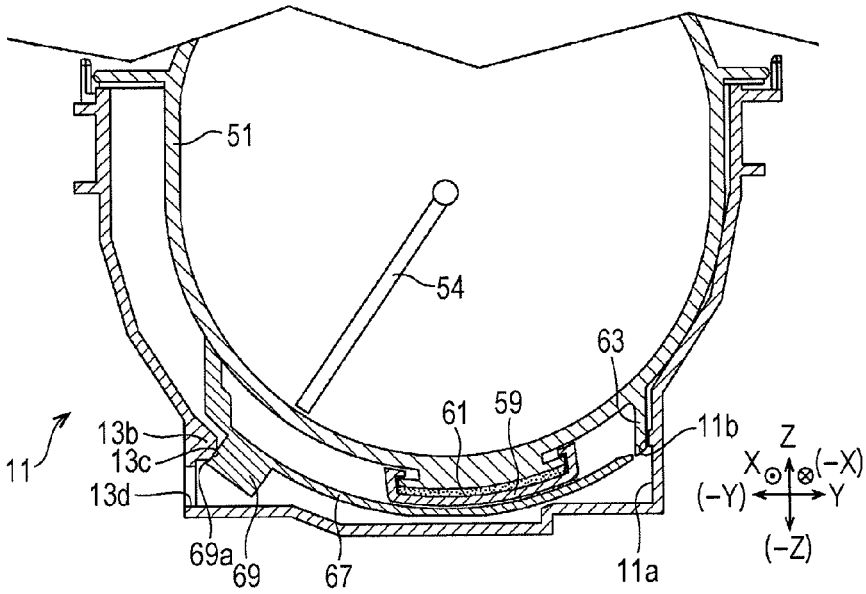
FIG. 6 is a sectional view illustrating the manner in which a first contact portion moves an outer shutter according to the exemplary embodiment.

FIG. 6 is a sectional view illustrating the manner in which a first contact portion moves the outer shutter according to the exemplary embodiment.

Referring to FIGS. 4A and 5, an eaves-shaped pushing portion 13*b*, which is an example of a second contact portion, is formed in a back section of the projection passage 13 so as to project rightward from a side wall 13*a* of the projection passage 13. As illustrated in FIG. 6, a contact surface 13*c* that extends in the radial direction of the cylindrical cartridge K is formed at a lower right part of the pushing portion 13*b*. As illustrated in FIGS. 4A and 6, a through hole 13*d*, which is an example of a receiving portion, is formed in the side wall 13*a* so as to extend through the side wall 13*a* in the left-right direction below the pushing portion 13*b*. As illustrated in FIGS. 5 and 6, a restricting projection 11*b*, which is an example of a restricting portion, is formed so as to project leftward from a right side portion 11*a* of the holder body 11 at a position corresponding to the pushing portion 13*b* in the front-back direction.

The projection passage 13, the helical guide groove 14, and the back guide groove 16 form an cover-member moving mechanism 13 to 16, which is an example of a guide portion, according to the present exemplary embodiment.

Description of Inlet Shutter Holder

An inlet-shutter holder 21, which is an example of a support member for an inlet cover member, is provided behind the ribs 17. The inlet-shutter holder 21 includes a bottom portion 22 at the bottom end thereof, and an inlet 23 is formed at a central area of the bottom portion 22. The inlet 23 extends through the holder body 11 in the up-down direction. Referring to FIG. 2, the inlet 23 opens into the reservoir tank RT at a position above the position where the empty-state detection sensor 4 is disposed at the back end of the reservoir tank RT.

Body shutter guides 24, which are examples of guide portions for guiding a body cover member, are formed integrally with the inlet-shutter holder 21 at the left and right sides thereof. The body shutter guides 24 extend in the front-back direction. According to the present exemplary embodiment, the body shutter guides 24 include left and right vertical walls 26 that extend upward from the left and right sides of the bottom portion 22, and top walls 27 that extend inward from the top ends of the vertical walls 26.

Recesses 28, which are examples of deformation-allowing portions, are formed in inner side surfaces of the top walls 27 in the left-right direction at the front end thereof. The recesses 28 are recessed outward in the left-right direction. Narrowing portions 29, inclined portions 31, and broadening portions 32 are formed on the inner side surfaces of the top walls 27 in the area behind the recesses 28. The narrowing portions 29 are examples of deformation-restraining portions, and extend backward. The inclined portions 31 are examples of guide portions, and extend from the back ends of the narrowing portions 29 such that the inclined portions 31 are inclined outward in the left-right direction toward the back. The broadening portions 32 are also examples of second deformation-allowing portions, and extend from the back ends of the inclined portions 31 so as to extend backward.

Left and right locking arms 33, which are examples of restraining-member bodies, are formed integrally with the inlet-shutter holder 21 so as to extend forward from the top walls 27. Locking claws 34, which are examples of contact portions, are formed so as to project inward in the left-right direction at the front ends of the locking arms 33. The locking claws 34 include front end faces 34*a*, which are examples of guide portions used in an attaching process, and back end faces 34*b*. The front end faces 34*a* are inclined inward in the left-right direction toward the back. The back end faces 34*b* extend in the left-right direction from the inner ends of the front end faces 34*a*.

Referring to FIGS. 4A to 4C, a plate-shaped body sealing member 36, which is an example of a leakage preventing member, is supported on the top surface of the bottom portion 22. In the present exemplary embodiment, the body sealing member 36 is composed of a sponge, which is an example of an elastic material. An opening 36*a* that corresponds to the inlet 23 is formed in the body sealing member 36.

Description of Body Shutter

Referring to FIGS. 4A to 4C, the body shutter 37, which is an example of an inlet cover member, is supported on the top surface of the body sealing member 36. Referring to FIGS. 4A to 4C, 5A, and 5B, in the present exemplary embodiment, the body shutter 37 includes a plate-shaped shutter body 38, which is an example of an cover-member body. The bottom surface of the shutter body 38 comes into contact with the body sealing member 36, so that the risk of leakage of the developer is reduced.

The shutter body 38 is supported by the body shutter guides 24 such that the shutter body 38 is movable in the front-back direction. Thus, the shutter body 38 may be moved forward to the position for closing the inlet 23 illustrated in FIG. 4B, or backward to the position for opening the inlet 23 illustrated in FIG. 4C.

Referring to FIGS. 4A to 4C, 5A, and 5B, a body engagement member 39 is supported on the top surface of the shutter body 38. The body engagement member 39 is substantially U-shaped as a whole, and is connected to the shutter body 38 at a back end portion 39*a* thereof that is positioned at a central position in the left-right direction. The body engagement member 39 includes left and right arms 39*b*, which are examples of deforming portions. The arms 39*b* extend forward from the back end portion 39*a* and are elastically deformable. Outer claw portions 39*c*, which are examples of restraining contact portions, and inner claw portions 39*d*, which are examples of engagement-state maintaining portions, are provided at the front ends of the arms 39*b*. The outer claw portions 39*c* project outward in the left-right direction and the inner claw portions 39*d* project inward in the left-right direction. In the present exemplary embodiment, the distance between the outer ends of the outer claw portions 39*c* is set in accordance with the distance between the broadening portions 32, more specifically, to a distance smaller than the distance between the recesses 28 and larger than the distance between the narrowing portions 29.

Referring to FIGS. 3 and 4A, a rotational shaft 47 is rotatably supported on the back end wall (not shown) at the back end of the holder body 11. A coupling 48, which is an example of a rotation-transmitting member, is supported at the front end of the rotational shaft 47. A cartridge driving gear 49, which is also an example of a rotation-transmitting member, is supported at the back end of the rotational shaft 47. The gear 49 is configured such that rotation of a drive source (not shown) may be transmitted thereto.

The cartridge holder KS according to the present exemplary embodiment includes the components denoted by reference numerals 11 to 49. The components denoted by reference numerals 11 to 49, in other words, the reservoir tank RT and the cartridge holder KS, form a transporting device body RT+KS according to the present exemplary embodiment.

Description of Cartridge

Referring to FIG. 3, the cartridge K according to the present exemplary embodiment includes a cylindrical cartridge body 51, which is an example of a developer container portion. The cartridge body 51 extends in the front-back direction and contains therein the developer to be supplied. An outlet 51*a*, which is an example of a connection hole, is formed in the cartridge body 51 at the back end thereof. The developer in the cartridge body 51 flows out of the cartridge body 51 through the outlet 51*a*.

A handle 52, which is an example of a handle portion, to be grabbed by a user is provided at the front end of the cartridge body 51.

A coupling 53, which is also an example of a rotation-transmitting member, is rotatably provided in the cartridge body 51 at the back end thereof. The coupling 53 meshes with the coupling 48 so that rotation is transmitted to the coupling 53. The back end of an agitator 54, which is an example of a developer transporting member, is connected to the coupling 53. In the present exemplary embodiment, the agitator 54 is formed in the shape of a coil spring, that is, in the shape obtained by helically winding a wire. When the coupling 53 is rotated, the agitator 54 transports the developer in the cartridge body 51 toward the outlet 51*a*.

Description of Inner Shutter and Guides Thereof

Figure 7A:
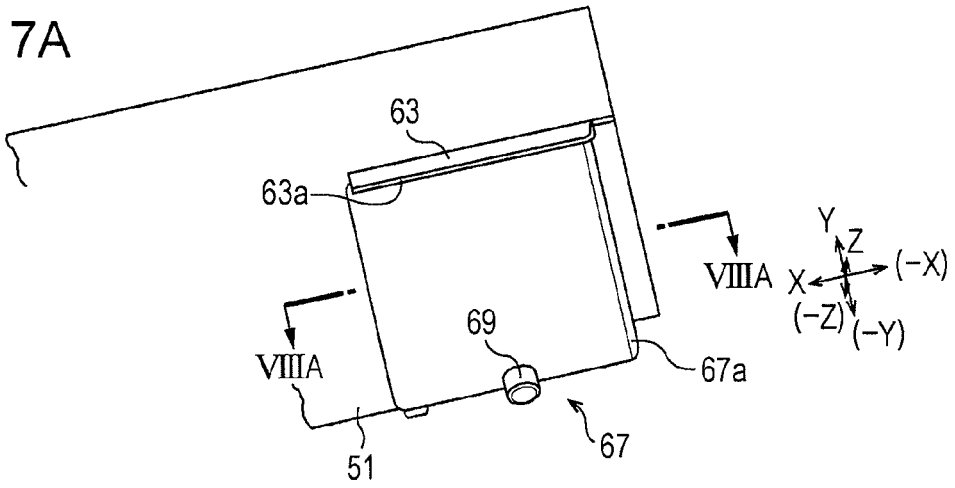
FIG. 7A illustrates a shutter unit on the cartridge according to the exemplary embodiment in the state in which the outer shutter is at a position for covering an outer side.
Figure 7B:
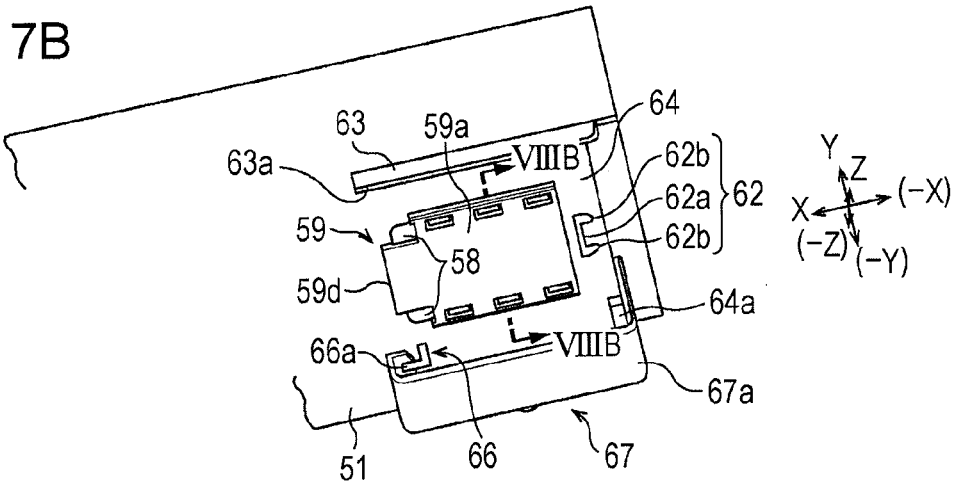
FIG. 7B illustrates the shutter unit in the state in which the outer shutter is at a position for exposing the outer side and an inner shutter is at a position for closing an outlet.
Figure 7C:
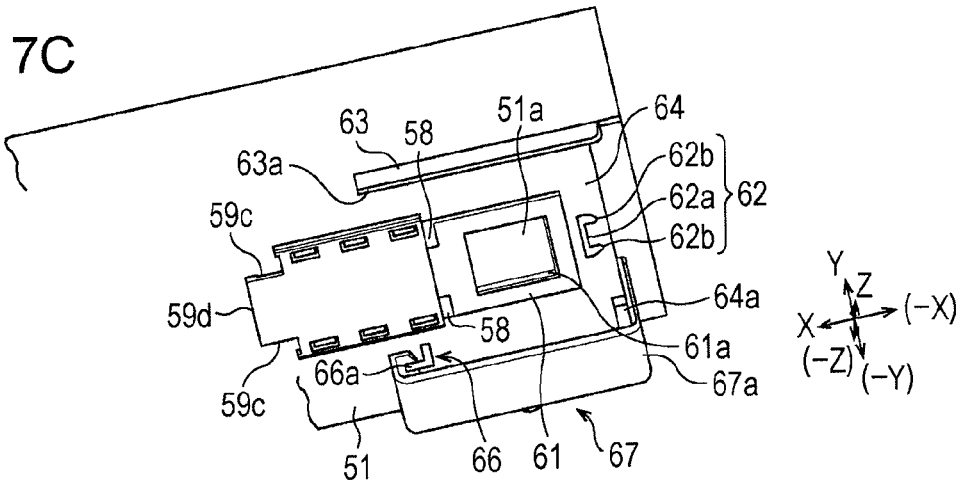
FIG. 7C illustrates the shutter unit in the state in which the outer shutter and the inner shutter are at positions for opening the outlet.

FIG. 7A illustrates a shutter unit on the cartridge K according to the present exemplary embodiment in the state in which an outer shutter 67 is at a position for covering an outer side. FIG. 7B illustrates the shutter unit in the state in which the outer shutter 67 is at a position for exposing the outer side and an inner shutter 59 is at a position for closing the outlet 51*a*. FIG. 7C illustrates the shutter unit in the state in which the outer shutter 67 and the inner shutter 59 are at positions for opening the outlet 51*a*.

Figure 8A:
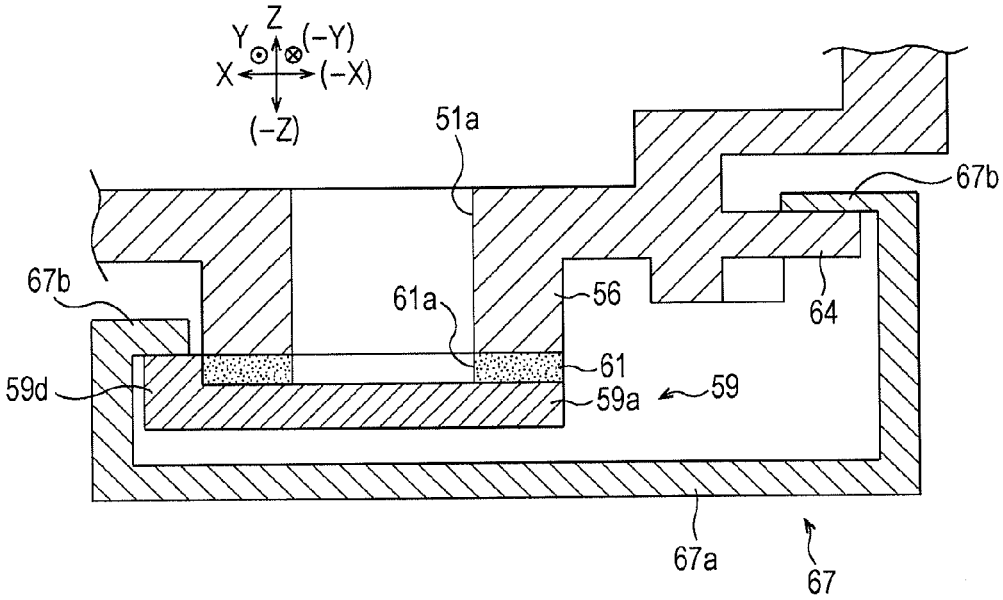
FIG. 8A is a sectional view of a shutter support according to the exemplary embodiment taken along line VIIIA-VIIIA in FIG. 7A.
Figure 8B:
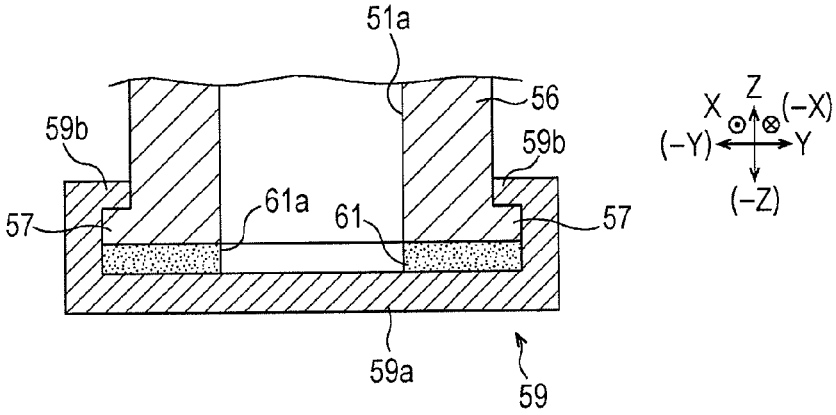
FIG. 8B is a sectional view of the shutter support taken along line VIIIB-VIIIB in FIG. 7B.

FIG. 8A is a sectional view of a shutter support 56 according to the present exemplary embodiment taken along line VIIIA-VIIIA in FIG. 7A. FIG. 8B is a sectional view of the shutter support 56 taken along line VIIIB-VIIIB in FIG. 7B.

Referring to FIGS. 7A to 8B, the shutter support 56, which is an example of a support member for an outlet cover member, is formed so as to project radially outward at the outer surface side of the outlet 51*a* at the back end of the cartridge body 51. As illustrated in FIG. 8B, the shutter support 56 is provided with inner shutter guides 57, which are examples of guide portions, at the left and right sides thereof. The inner shutter guides 57 protrude outward in the left-right direction.

Referring to FIGS. 7B and 7C, lock cancelling portions 58, which are examples of releasing portions, are formed at the front end of the shutter support 56, that is, at the downstream end thereof in the direction in which the cartridge K is detached. In the present exemplary embodiment, the lock cancelling portions 58 are formed so as to extend from the inner shutter guides 57 at the front ends thereof, and provides the function of the inner shutter guides 57. In other words, the lock cancelling portions 58 according to the present exemplary embodiment are formed integrally with the inner shutter guides 57 and function also as the inner shutter guides 57.

Referring to FIGS. 7B and 7C, the inner shutter 59, which is an example of a first cover member or an outlet cover member, is supported by the inner shutter guides 57 such that the inner shutter 59 is movable in the front-back direction. The inner shutter 59 includes a plate-shaped inner shutter body 59*a*, which is an example of a first cover member body. Referring to FIG. 8B, inner guide portions 59*b*, which are examples of guided portions, are formed at the left and right sides of the inner shutter body 59*a*. The inner guide portions 59*b* extend in the front-back direction and are guided by the inner shutter guides 57. Thus, the inner shutter 59 according to the present exemplary embodiment is supported so as to be movable between the position for closing the outlet 51*a* illustrated in FIG. 7B and the position for opening the outlet 51*a* illustrated in FIG. 7C.

Left and right notched portions 59*c*, which are examples of receiving portions, are formed at the front end of the inner shutter body 59*a*. The notched portions 59*c* are formed so as to correspond to the lock cancelling portions 58 such that the lock cancelling portions 58 are outwardly exposed at the notched portions 59*c*. Referring to FIGS. 7B and 8A, an outer-shutter extension guide 59*d*, which is an example of a second cover member guide portion, is formed between the notched portions 59*c*. When the inner shutter 59 is at the closed position, the outer-shutter extension guide 59*d* projects forward beyond a front edge of the shutter support 56.

The inner shutter 59 according to the present exemplary embodiment is configured to be placed between the locking arms 33 when the cartridge K is attached to the cartridge holder KS. Accordingly, the width of the inner shutter 59 in the left-right direction corresponds to the distance between the locking arms 33. In addition, with regard to the length of the inner shutter 59 in the front-back direction, the distance from the back end of the inner shutter 59 to the back ends of the notched portions 59*c* corresponds to the distance from the front end of the body sealing member 36 to the back end faces 34*b* of the locking claws 34. The thickness of the body 59*a* of the inner shutter 59 is set such that the top surface of the body 59*a* of the inner shutter 59 is flush with the top surface of the body sealing member 36.

Referring to FIGS. 7A to 8B, a cartridge sealing member 61, which is an example of a leakage preventing member, is provided between the outer surface of the shutter support 56 and the inner shutter 59. The cartridge sealing member 61 is made of an elastic material, and prevents leakage of the developer through a gap between the inner shutter 59 and the shutter support 56. As illustrated in FIG. 7C, an opening 61*a* which corresponds to the outlet 51*a* is formed in the cartridge sealing member 61 at a central area thereof. The shape of the cartridge sealing member 61 according to the present exemplary embodiment corresponds to the shape of the inner shutter 59. The cartridge sealing member 61 is not provided in areas corresponding to the notched portions 59*c* in the inner shutter 59, that is, in the areas corresponding to the lock cancelling portions 58.

In the present exemplary embodiment, the vertical distance from the top surfaces of the inner shutter guides 57 to the bottom surface of the cartridge sealing member 61 corresponds to the vertical distance from the bottom surfaces of the body shutter guides 24 to the top surface of the body sealing member 36. In addition, the width of the shutter support 56 in the left-right direction is smaller than the distance between the narrowing portions 29 of the inlet-shutter holder 21, and the distance between the outer ends of the inner shutter guides 57 in the left-right direction is smaller than the distance between the body shutter guides 24. Accordingly, when the cartridge K is attached to the cartridge holder KS, the inner shutter guides 57 are guided by the body shutter guides 24 and the shutter support 56 is placed in the inlet-shutter holder 21. As a result, the outlet 51*a* is connected to the inlet 23.

Referring to FIGS. 7A to 8B, a cartridge engagement member 62, which is an example of an inlet-cover-member moving part, is formed so as to project radially outward from the outer peripheral surface of the cartridge body 51 at a position behind the shutter support 56. The cartridge engagement member 62 substantially has the shape of a letter 'U' that faces backward, and includes a front end portion 62*a* that extends in the left-right direction and insertion portions 62*b* that extend backward from the left and right ends of the front end portion 62*a*. The insertion portions 62*b* are formed such that outer side surfaces thereof in the left-right direction are inclined inward in the left-right direction toward the back.

The size of the cartridge engagement member 62 according to the present exemplary embodiment is set such that the cartridge engagement member 62 may be placed in the body engagement member 39. The length of the front end portion 62*a* in the left-right direction is smaller than the distance between the arms 39*b* and larger than the distance between the inner ends of the inner claw portions 39*d*. The distance between the back ends of the insertion portions 62*b*, that is, the downstream end thereof in the direction in which the cartridge K is attached, is smaller than the distance between the inner ends of the inner claw portions 39*d*.

Description of Outer Shutter and Guides Thereof

Referring to FIGS. 6, 8A, and 8B, a rib-shaped stopper 63, which is an example of a part for which the clearance is regulated and which is also an example of a second-cover-member stopper, is formed on the outer surface of the cartridge body 51 on the right side of the shutter support 56. The stopper 63 extends in the front-back direction and projects outward. In the present exemplary embodiment, the stopper 63 also has a function of covering an opening at the right side of the outer shutter 67, as described below.

In addition, when the cartridge K is attached to or detached from the cartridge holder KS, the stopper 63 of the present exemplary embodiment is guided along the inner side surface, or the left side surface, of the right side portion 11*a* of the holder body 11.

Figure 9A:
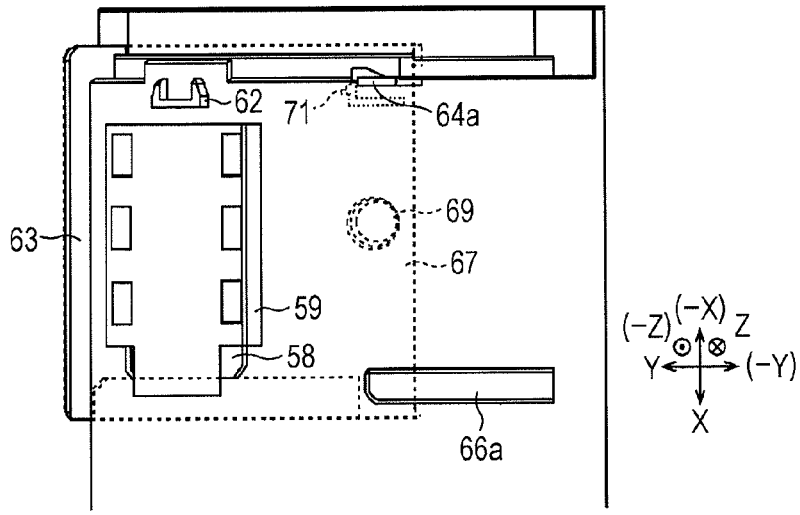
FIG. 9A illustrates a cover member according to the exemplary embodiment at a stopped position.
Figure 9B:
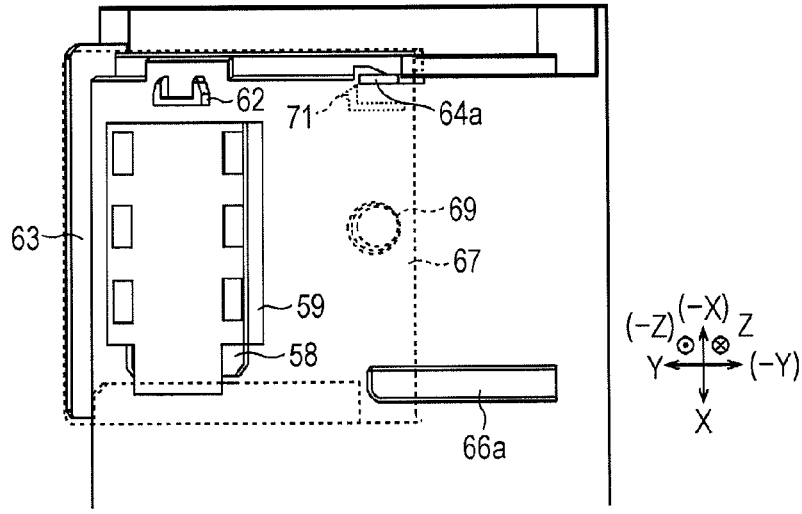
FIG. 9B illustrates the cover member at a released position where the cover member is released from the stopped state.
Figure 9C:
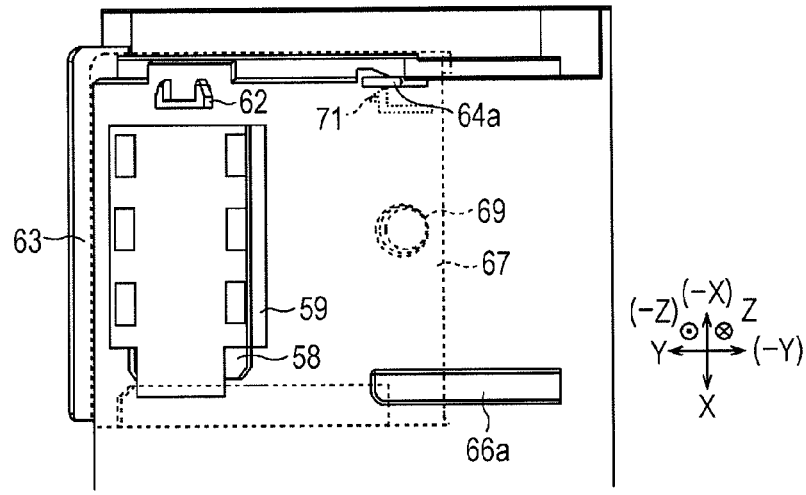
FIG. 9C illustrates the state in which the cover member has started to move toward the position for exposing the outer side from the state illustrated in FIG. 9B.

FIG. 9A illustrates a cover member according to the exemplary embodiment at a stopped position. FIG. 9B illustrates the cover member at a released position where the cover member is released from the stopped state. FIG. 9C illustrates the state in which the cover member has started to move toward the position for exposing the outer side from the state illustrated in FIG. 9B.

Figure 10:
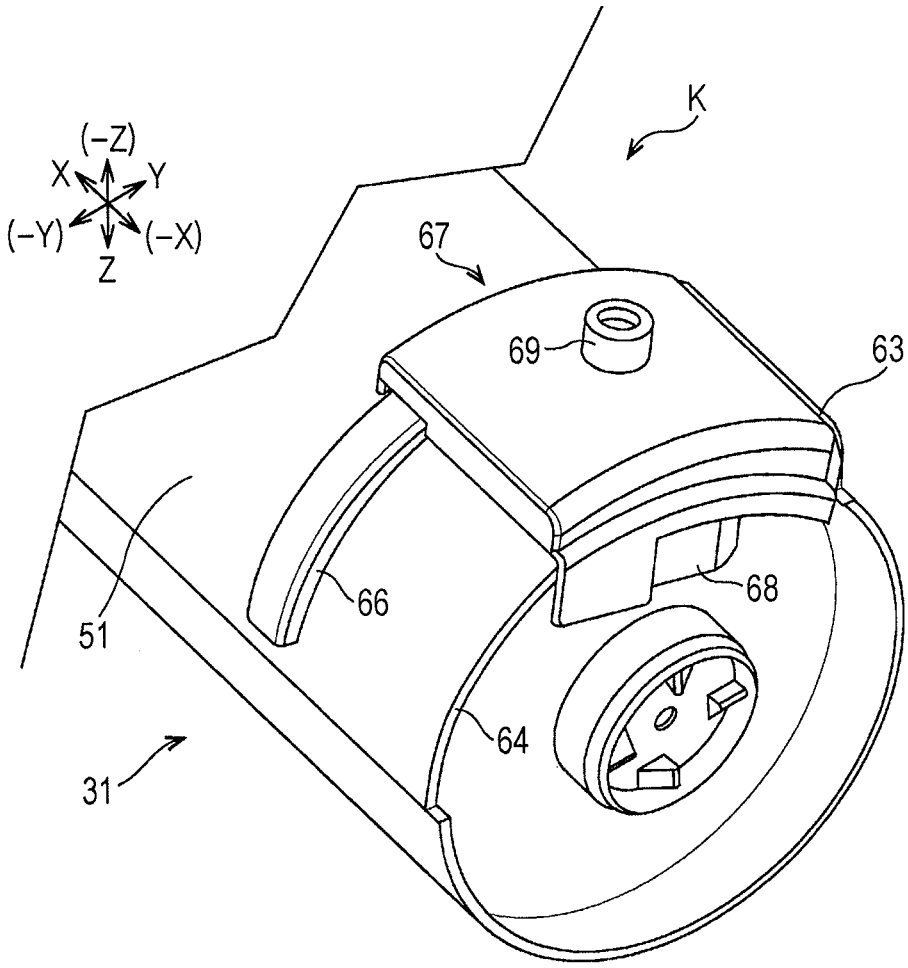
FIG. 10 illustrates the cartridge according to the exemplary embodiment viewed obliquely from below.

As illustrated in FIGS. 7B, 7C, and 8A, an outer-shutter back guide 64, which is also an example of a second cover member guide portion, is formed at the back end of the cartridge body 51. The outer-shutter back guide 64 protrudes backward in an arc shape along the cartridge body 51. Referring to FIGS. 7B, 7C, and 10, a locking projection 64*a*, which is an example of a second stopper portion, is formed at the back end of the cartridge body 51 so as to project radially outward from the outer surface of the outer-shutter back guide 64.

In FIG. 7C, an outer-shutter front guide 66, which is also an example of a second cover member guide portion, is formed at a position on the left of the shutter support 56. The front guide 66 is formed in an ark shape on the extension of the outer-shutter extension guide 59*d* in the circumferential direction. A right end 66*a* of the front guide 66 is located at a position separated from the shutter support 56 in the circumferential direction of the cartridge body 51 so that the front guide 66 does not interfere with the movement of the inner shutter 59.

FIG. 10 illustrates the cartridge K according to the present exemplary embodiment viewed obliquely from below.

Referring to FIGS. 7A to 10, the outer shutter 67, which is an example of a second cover member or an outer-side cover member, is supported by the outer shutter guides 64, 66, and 59*d*. The outer shutter 67 includes an outer shutter body 67*a*, which is an example of a body of the second cover member. The outer shutter body 67*a* has a partial cylindrical shape that extends along the outer peripheral surface of the cartridge body 51. Outer guide portions 67*b*, which are examples of guided portions, are formed at the front and back ends of the outer shutter body 67*a*. The outer guide portions 67*b* are guided by the outer-shutter guides 64, 66, and 59*d*. Thus, the outer shutter 67 is supported so as to be moveable along the outer-shutter guides 64, 66, and 59*d* in the circumferential direction of the cartridge body 51. The outer shutter 67 moves between the position for covering the outer side illustrated in FIG. 7A, which is an example of a position where the outer shutter 67 covers both the outlet 51*a* and the inner shutter 59, and the position for exposing the outer side illustrated in FIG. 7B, which is an example of a position where the outer shutter 67 does not cover the inner shutter 59 so that the inner shutter 59 is exposed. Thus, according to the present exemplary embodiment, the outer shutter 67 moves along an arc path in the circumferential direction of the cylindrical cartridge body 51 between the position for covering the outer side and the position for exposing the outer side.

In the present exemplary embodiment, the outer shutter 67 is supported by the guides 64, 66, and 59*d* with gaps, that is, clearances, provided therebetween. Owing to the clearances, the outer shutter 67 is movable between the back stopped position illustrated in FIG. 9A and the front released position illustrated in FIG. 9B.

In FIG. 10, a leaf-spring-shaped spring portion 68, which is an example of an urging portion, is provided on the outer guide portion 67*b* at the back end of the outer shutter 67. The spring portion 68 extends rightward from a base end portion at the left end. An end of the spring portion 68 is in contact with a back surface of the cartridge body 51 so as to urge the outer shutter 67 backward. In other words, the spring portion 68 constantly urges the outer shutter 67 toward the stopped position illustrated in FIG. 9A.

As illustrated in FIG. 7A, an outer opening-closing projection 69, which is an example of a first contact portion, is formed on the outer surface of the outer shutter 67 so as to project outward. Referring to FIGS. 6 and 7A to 7C, the outer opening-closing projection 69 has a columnar shape and extends in the radial direction of the cartridge body 51. The outer opening-closing projection 69 includes a cylindrical outer surface 69*a*, which extends in the radial direction, as an example of a contact surface. Referring to FIG. 6, in the present exemplary embodiment, the contact surface 13*c* of the pushing portion 13*b* faces the outer surface 69*a* of the outer opening-closing projection 69 and is capable of coming into contact therewith.

The outer opening-closing projection 69 is formed so as to correspond to the shutter passage 12, and is capable of coming into contact with the inner side surfaces of the guide grooves 14 and 16.

Referring to FIGS. 9A to 9C, a locking lug 71, which is an example of a first stopper portion, is formed on the inner surface of the outer shutter 67 at the left end thereof. The locking lug 71 extends rearward at a position corresponding to the locking projection 64*a* in the state in which the outer shutter 67 at the position for covering the outer side. According to the present exemplary embodiment, the length of the locking lug 71 is set such that the locking lug 71 is in contact with the locking projection 64*a*, as illustrated in FIG. 9A, when the outer shutter 67 is at the above-described stopped position and is separated from the locking projection 64*a*, as illustrated in FIG. 9B, when the outer shutter 67 is at the released position.

Therefore, referring to FIG. 9A, when the outer shutter 67 is at the stopped position, the locking lug 71 is in contact with the locking projection 64*a* so that the outer shutter 67 is retained, or locked, at the position for covering the outer side. Accordingly, the outer shutter 67 is prevented from moving toward the position for exposing the outer side, and is retained in the stopped state. Referring to FIG. 9B, when the outer shutter 67 is at the released position, the locking lug 71 and the locking projection 64*a* are separated from each other so that the outer shutter 67 is unlocked. Accordingly, the outer shutter 67 is movable toward the position for exposing the outer side, as illustrated in FIG. 9C.

The cartridge K, which is an example of a developer container according to the present exemplary embodiment, includes the components denoted by reference numerals 51 to 67. A developer transporting device RT+KS+K according to the present exemplary embodiment includes the transporting device body RT+KS and the cartridge K.

Operation of Exemplary Embodiment

In the copy machine U according to the present exemplary embodiment including the above-described components, a latent image formed on the surface of the photoconductor drum PR is developed by the developing device G in the developing area Q2. Thus, the developer in the developing device G is consumed. As the developer in the developing device G is consumed, the supplying auger 2 and the transporting system GH are operated to supply the developer from the cartridge K in accordance with the amount of consumption.

When, for example, all the developer in the cartridge K is supplied and the cartridge K becomes empty or when the cartridge K does not function properly, the cartridge K is replaced with a new cartridge K by pulling out the old cartridge K and inserting the new cartridge K in the front-back direction of the copy machine body U1.

Description of Cartridge Attaching Operation

Referring to FIGS. 3, 4, and 7A, when the cartridge K is inserted into the cartridge holder KS from the front, the outer opening-closing projection 69 on the outer shutter 67 moves backward along the projection passage 13 and comes into contact with the bottom end of the helical guide groove 14. When the outer opening-closing projection 69 comes into contact with the bottom end of the helical guide groove 14, the outer shutter 67 receives a forward reaction force from the helical guide groove 14. Accordingly, the outer shutter 67 moves from the stopped position illustrated in FIG. 9A to the released position illustrated in FIG. 9B, and the outer shutter 67 is unlocked. In this state, the outer shutter 67 is capable of moving toward the position for exposing the outer side.

Then, when the cartridge K is further inserted, the outer opening-closing projection 69 is guided along the helical guide groove 14 so that the outer shutter 67 is moved upward along the circumferential direction of the cartridge body 51 as the outer shutter 67 is moved backward. Thus, when the cartridge K is inserted by being moved backward, the outer shutter 67 is moved in the circumferential direction from the position for covering the outer side illustrated in FIG. 7A to the position for exposing the outer side illustrated in FIGS. 7B and 7C. As a result, the inner shutter 59 is exposed.

Figure 11A:
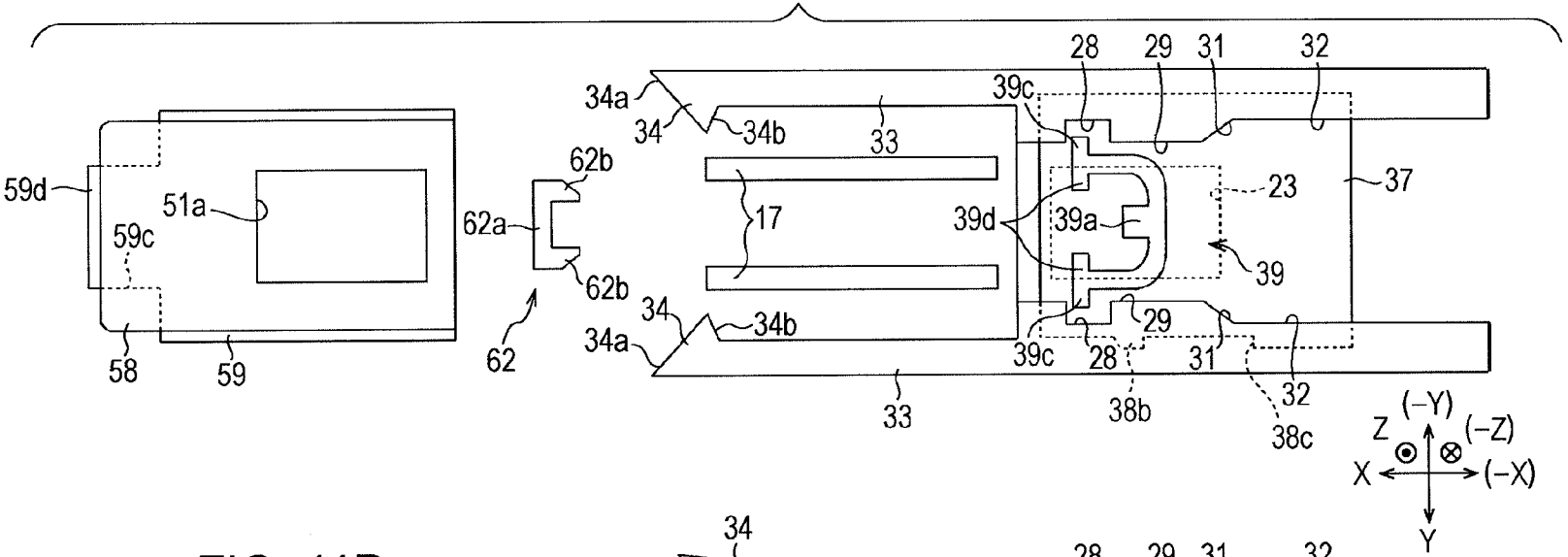
Figure 11B:
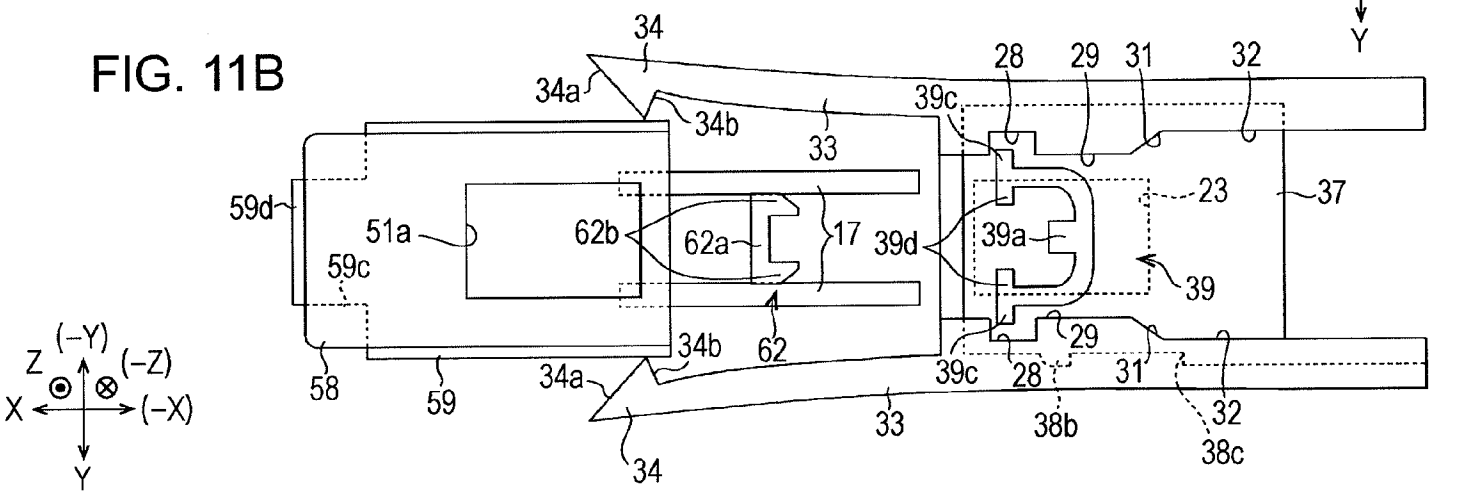

FIGS. 11A and 11B illustrate the states of the body shutter 37, a supply-hole/shutter lock member, the cartridge inner shutter 59, the shutter support 56, and a cartridge engagement member 62 according to the present exemplary embodiment. FIG. 11A illustrates the state in which the cartridge K is separated from the body. FIG. 11B illustrates the state in which the cartridge K is inserted from the state illustrated in FIG. 11A to the state in which the cartridge inner shutter 59 is in contact with the locking arms 33.

Referring to FIGS. 11A and 11B, when the cartridge K is further inserted into the body while the inner shutter 59 is exposed, the inner shutter 59 in the state illustrated in FIG. 11A approaches the inlet-shutter holder 21. Then, the cartridge engagement member 62 moves backward through the space between the locking claws 34, and the back end of the inner shutter 59, that is, the downstream end thereof in the direction in which the cartridge K is attached, comes into contact with the front end faces 34*a* of the locking arms 33. Then, when the cartridge K in this state is further inserted, the locking arms 33 are elastically deformed outward, as illustrated in FIG. 11B. Accordingly, the inner shutter 59 and the shutter support 56 on the cartridge K may be moved further backward.

Figure 12A:
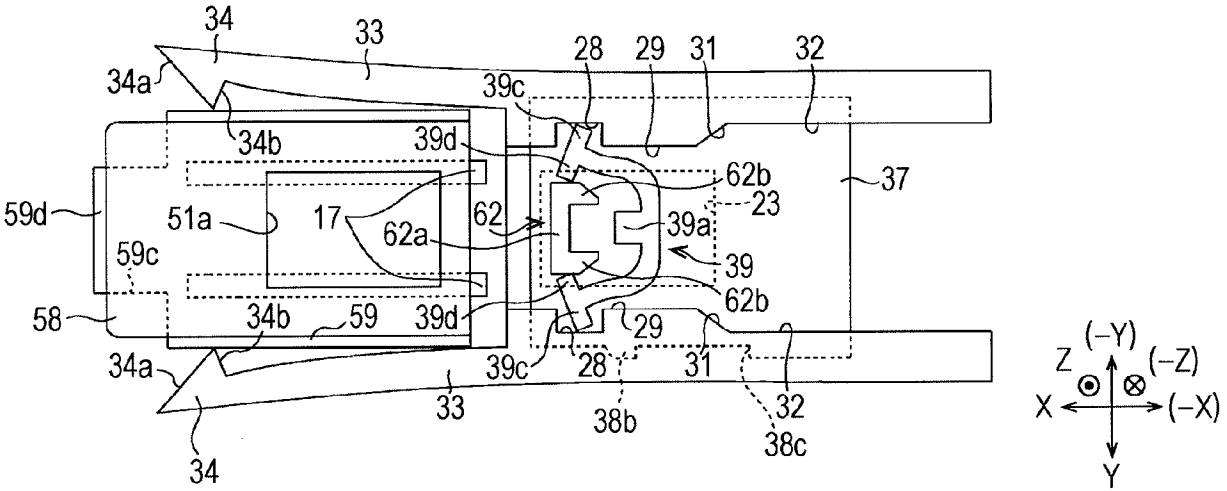
Figure 12B:
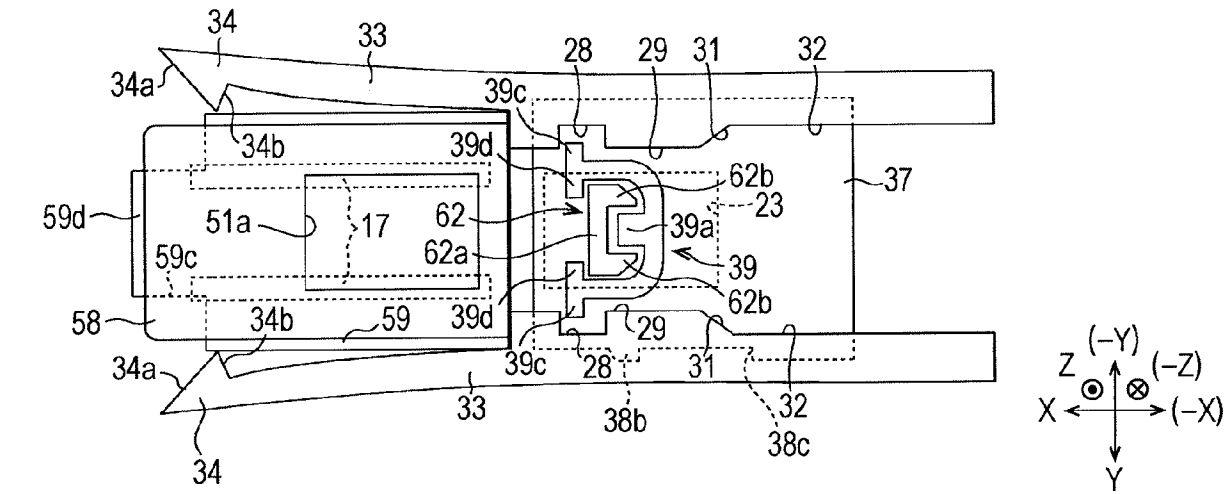

FIGS. 12A and 12B illustrate the states after the states in FIGS. 11A and 11B. FIG. 12A illustrates the state in which the cartridge K is further inserted from the state illustrated in FIG. 11B and the cartridge engagement member 62 is in contact with the body engagement member 39. FIG. 12B illustrates the state in which the cartridge K is further inserted from the state illustrated in FIG. 12A and the cartridge engagement member 62 is placed in the body engagement member 39.

When the cartridge K is further moved backward from the state illustrated in FIG. 11B, the bottom surface of the inner shutter 59 is guided and pushed upward by the rattling preventing ribs 17. Accordingly, rattling in the up-down direction is suppressed and the inner shutter 59 is positioned in the up-down direction. When the cartridge engagement member 62 reaches the body engagement member 39, the insertion portions 62*b* of the cartridge engagement member 62 are inserted into the space between the inner claw portions 39*d* and try to push the arms 39*b* away from each other. At this time, the outer claw portions 39*c* are placed in the recesses 28 in the inlet-shutter holder 21, and are therefore allowed to move outward in the left-right direction. Therefore, as illustrated in FIG. 12A, the arms 39*b* are elastically deformed and pushed outward.

Then, when the cartridge K is further inserted backward from the state illustrated in FIG. 12A and the cartridge engagement member 62 is placed in the body engagement member 39, the arms 39*b* elastically restore their original shapes, as illustrated in FIG. 12B. Accordingly, the inner claw portions 39*d* face each other in front of the front face of the front end portion 62*a* of the cartridge engagement member 62. Thus, the cartridge engagement member 62 is restrained from moving with respect to the body shutter 37. In other words, the cartridge engagement member 62 is locked.

When the cartridge K is further moved backward from the state illustrated in FIG. 12B, the cartridge engagement member 62 pushes the body engagement member 39 and the body shutter 37 moves backward. More specifically, the body shutter 37 moves from the position for closing the inlet 23 to the position for opening the inlet 23. When the back end of the inner shutter 59 comes into contact with the front end of the body sealing member 36, the movement of the inner shutter 59 stops. Accordingly, only the shutter support 56 moves backward together with the cartridge K. In other words, the inner shutter 59 relatively moves from the position for closing the outlet 51*a* to the position for opening the outlet 51*a*.

Figure 13A:
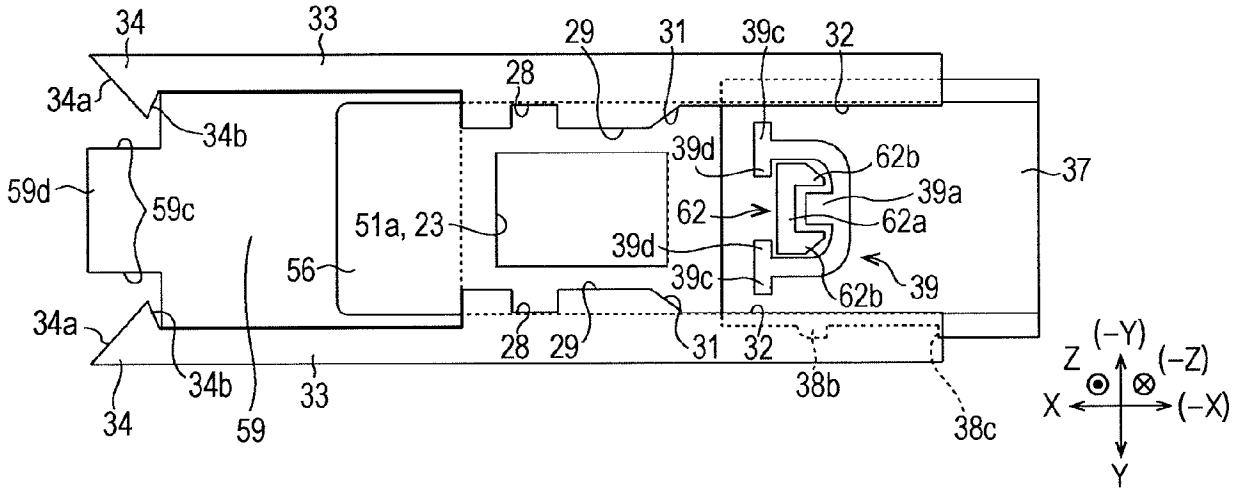
Figure 13B:
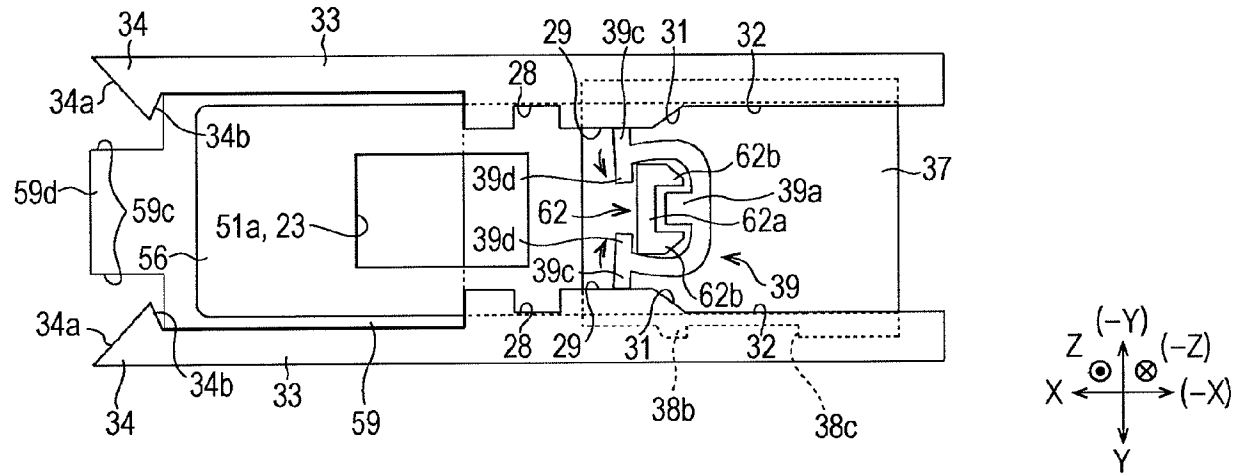

FIGS. 13A and 13B illustrate the states after the states in FIGS. 12A and 12B. FIG. 13A illustrates the state in which the cartridge K is further inserted from the state illustrated in FIG. 12B and the insertion of the cartridge K is completed. FIG. 13B illustrates the state in which the cartridge K is pulled outward from the state illustrated in FIG. 13A and deformation of the body engagement member 39 is suppressed.

Referring to FIG. 13A, when the cartridge K is inserted to the deepest position, as illustrated in FIG. 3, the shutters 37 and 59 are moved to the positions for opening the inlet 23 and the outlet 51*a*, and the outlet 51*a* and the inlet 23 are connected to each other, as illustrated in FIG. 13A. In this state, the developer may be supplied from the cartridge K to the reservoir tank RT.

In the state illustrated in FIG. 13A, the shutter support 56 of the cartridge K is moved backward such that the lock cancelling portions 58 are separated from the notched portions 59*c* in the inner shutter 59. Accordingly, as illustrated in FIG. 13A, the locking claws 34 are released from the lock cancelling portions 58 and the locking arms 33 elastically restore their original shapes such that the notched portions 59*c* are placed between the locking claws 34. In this state, movement of the inner shutter 59 in the front-back direction is restrained by the locking arms 33. In other words, the inner shutter 59 is locked by the locking arms 33.

Description of Cartridge Detaching Operation

When, for example, the cartridge K becomes empty and the cartridge K is to be removed, the cartridge K is pulled forward. When the cartridge K is pulled forward from the state illustrated in FIG. 13A, the inner shutter 59 is locked by the locking claws 34 of the locking arms 33 and cannot move. Accordingly, only the shutter support 56 moves forward together with the cartridge K. Thus, the locking arms 33 relatively move the inner shutter 59 to the position for closing the outlet 51*a*. At this time, the cartridge engagement member 62 is also locked by the body engagement member 39, so that the body engagement member 39 is also pulled forward as the cartridge engagement member 62 on the cartridge K is moved forward. As a result, the body shutter 37 is also moved forward, that is, toward the position for closing the inlet 23.

When the body shutter 37 is moved forward, the arms 39*b* of the body engagement member 39 receive a force that tries to push the arms 39*b* away from each other from the cartridge engagement member 62 that moves forward. However, in the present exemplary embodiment, the distance between the outer ends of the outer claw portions 39*c* corresponds to the distance between the broadening portions 32. Accordingly, even when the arms 39*b* try to expand outward, the outer claw portions 39*c* come into contact with the broadening portions 32 and the arms 39*b* cannot expand outward. Thus, the cartridge engagement member 62 is prevented from being pulled out from the body engagement member 39.

When the cartridge K is further pulled forward, the outer claw portions 39*c* of the body engagement member 39 come into contact with the inclined portions 31 and the narrowing portions 29, so that the arms 39*b* receive a force that pushes the arms 39*b* inward. Accordingly, the cartridge engagement member 62 is reliably prevented from being pulled out from the body engagement member 39. Therefore, in the present exemplary embodiment, the risk that the engagement members 39 and 62 will be disengaged from each other and the body shutter 37 will be stopped at the position for opening the inlet 23 or an intermediate position before the body shutter 37 returns to the position for closing the inlet 23 may be reduced.

Figure 14:
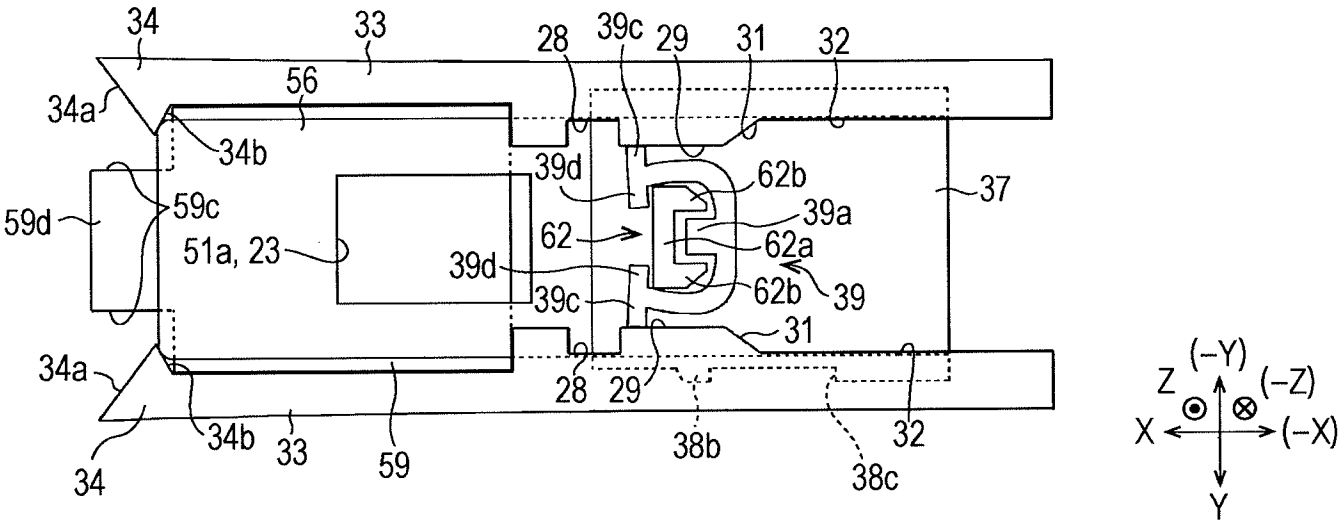
FIG. 14 illustrates the state after the state in FIG. 13B, in which the cartridge is further pulled outward from the state illustrated in FIG. 13B and lock cancelling portions are in contact with the locking arms.

FIG. 14 illustrates the state after the state in FIG. 13B, in which the cartridge K is further pulled outward from the state illustrated in FIG. 13B and the lock cancelling portions 58 are in contact with the locking arms 33.

When the cartridge K is moved forward from the state illustrated in FIG. 13B and reaches the position illustrated in FIG. 14, the lock cancelling portions 58 come into contact with the back end faces 34*b* of the locking claws 34. Then, when the cartridge K in this state is further moved forward, the locking claws 34 are pushed outward by the lock cancelling portions 58 and the locking arms 33 are elastically deformed outward. Accordingly, the state illustrated in FIG. 12B is established, so that the inner shutter 59 returns to the position for closing the outlet 51*a* and is released from the locked state. Then, as the cartridge K is moved forward, the inner shutter 59 is moved forward together with the shutter support 56 while the outlet 51*a* is closed by the inner shutter 59.

When the cartridge K reaches the position illustrated in FIG. 12B, the body shutter 37 is moved to the position for closing the inlet 23 and the inlet 23 is closed by the body shutter 37. Then, forward movement of the body shutter 37 is restrained by a stopper (not shown). In this state, the outer claw portions 39*c* are at positions corresponding to the recesses 28, so that the arms 39*b* are allowed to be elastically deformed outward. Therefore, when the cartridge K in the state illustrated in FIG. 12B is further moved forward, the arms 39*b* are pushed away from each other, as illustrated in FIG. 12A, and the cartridge engagement member 62 is pulled out from the body engagement member 39.

When the cartridge K is further moved forward, the cartridge K is set to the states illustrated in FIGS. 11B and 11A in that order. Then, the outer opening-closing projection 69 is guided by the helical guide groove 14 and the outer shutter 67 is moved to the position for covering the outer side.

Figure 15A:
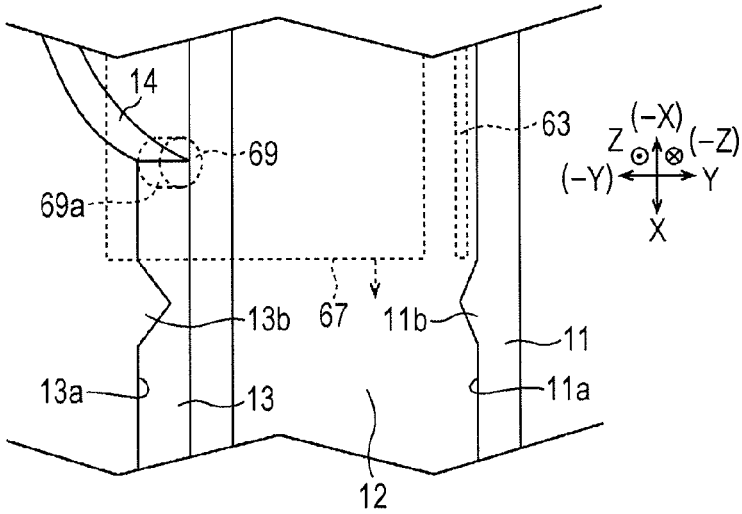
FIG. 15A illustrates the state in which an outer opening-closing projection is moved from a helical guide groove to a projection passage in the exemplary embodiment.
Figure 15B:
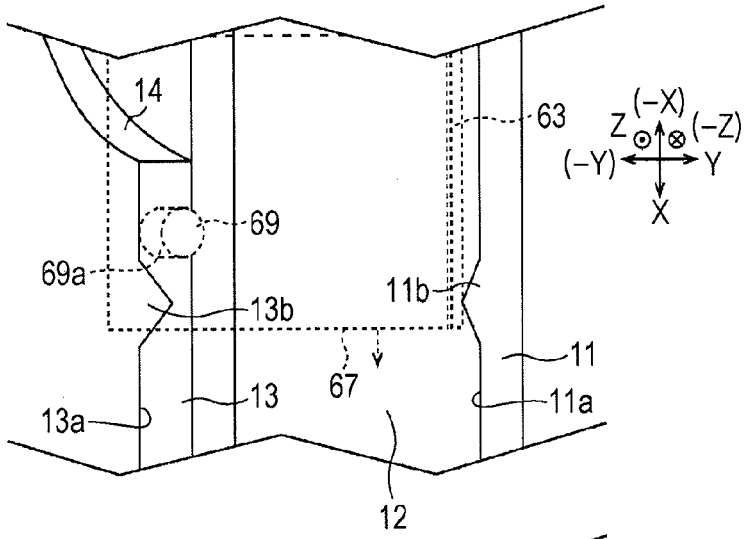
FIG. 15B illustrates the state in which the cartridge is pulled outward from the state illustrated in FIG. 15A and a stopper is in contact with a restricting projection.
Figure 15C:
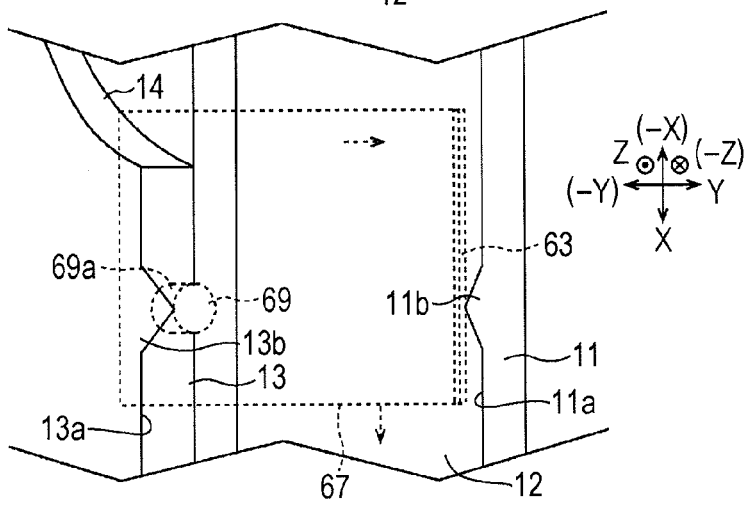
FIG. 15C illustrates the state in which the cartridge is further pulled outward from the state illustrated in FIG. 15B and the outer opening-closing projection is in contact with a pushing portion.

FIG. 15A illustrates the state in which the outer opening-closing projection 69 is moved from the helical guide groove 14 to the projection passage 13 in the present exemplary embodiment. FIG. 15B illustrates the state in which the cartridge K is pulled outward from the state illustrated in FIG. 15A and the stopper is in contact with the restricting projection 11*b*. FIG. 15C illustrates the state in which the cartridge K is further pulled outward from the state illustrated in FIG. 15B and the outer opening-closing projection 69 is in contact with the pushing portion 13*b*.

Referring to FIG. 15A, when the outer opening-closing projection 69 reaches the front end of the helical guide groove 14, the force that pushes the outer shutter 67 toward the position for covering the outer side is eliminated. When the cartridge K is pulled forward from the state illustrated in FIG. 15A, the stopper 63 comes into contact with the restricting projection 11*b*, as illustrated in FIG. 15B, so that the entire body of the cartridge K is pushed leftward. Accordingly, a clearance between the cartridge K and the holder body 11 is reduced.

When the cartridge K is pulled forward from the state illustrated in FIG. 15B, the outer opening-closing projection 69 comes into contact with the pushing portion 13*b*, as illustrated in FIGS. 15C and 6. Accordingly, the outer shutter 67 is pushed and moved to the position for covering the outer side. When the outer shutter 67 is moved to the position for covering the outer side, the outer shutter 67 receives no force that pushes the outer shutter 67 forward. Accordingly, the outer shutter 67 receives the elastic force of the spring portion 68, so that the outer shutter 67 is moved to the stopped position and locked.

As a result, the cartridge K is removed while the outlet 51*a* of the cartridge K is closed by both the inner shutter 59 and the outer shutter 67 and the inlet 23 is closed by the body shutter 37.

Accordingly, in the copy machine U of the present exemplary embodiment, the outer opening-closing projection 69 comes into contact with and pushed by the pushing portion 13*b* when the cartridge K is pulled out. In general, there is a possibility that the outer shutter 67 will not move to the position for covering the outer side because of, for example, clearances between the cartridge K and the holder body 11, manufacturing errors of components such as the outer shutter 67, or assembly errors. In contrast, according to the present exemplary embodiment, the pushing portion 13*b* pushes the outer opening-closing projection 69 so as to move the outer shutter 67 to the position for covering the outer side.

According to the present exemplary embodiment, the pushing portion 13*b* has the contact surface 13*c* that extends along the outer surface 69*a* of the outer opening-closing projection 69 that extends in the radial direction. The contact surface 13*c* comes into contact with the outer surface 69*a* and pushes the outer shutter 67. The pushing force is applied by the contact surface 13*c* to the outer surface 69*a* along the circumferential direction in which the outer shutter 67 moves.

In the present exemplary embodiment, the pushing portion 13*b* is eaves-shaped and a space for receiving an end portion of the outer opening-closing projection 69 is provided under the pushing portion 13*b*. In addition, the through hole 13*d* is formed in the side wall 13*a*.

In the present exemplary embodiment, when the pushing portion 13*b* pushes the outer shutter 67, the restricting projection 11*b* is in contact with the stopper 63 so that the clearance between the cartridge K and the holder body 11 is reduced.

In the present exemplary embodiment, when the cartridge K is detached from the copy machine U, the outer shutter 67 receives the elastic force of the spring portion 68 so that the locking lug 71 and the locking projection 64*a* are in contact with each other. Accordingly, the outer shutter 67 is locked at the position for covering the outer side. In the present exemplary embodiment, the lock cancelling portions 58 are formed integrally with the inner shutter guides 57, and may be easily formed.

In addition, in the cartridge K according to the present exemplary embodiment, two shutters, which are the inner shutter 59 and the outer shutter 67, are provided. Therefore, even when leakage of the developer occurs at the inner shutter 59, the developer may be prevented from leaking to the outside by the outer shutter 67. Thus, leakage of the developer and stains caused thereby may be reduced. In the present exemplary embodiment, the lock cancelling portions 58 are provided on the shutter support 56. Therefore, the size of the outer shutter 67 may be reduced.

In addition, in the cartridge K according to the present exemplary embodiment, the guide extending portion 59*d* capable of guiding the outer shutter 67 is formed on the inner shutter 59.

MODIFICATIONS

Although an exemplary embodiment of the present invention is described in detail above, the present invention is not limited to the above-described exemplary embodiment, and various modifications are possible within the scope of the present invention defined by the claims. Modifications (H01) to (H10) of the present invention will now be described below.

(H01) Although the copy machine U is described as an example of an image forming apparatus in the above-described exemplary embodiment, the image forming apparatus is not limited to this, and may instead be, for example, a printer, a facsimile machine, or a multifunction machine having the functions of these machines. In addition, the image forming apparatus is also not limited to a monochrome image forming apparatus, and may instead be a multicolor image forming apparatus.

(H02) In the above-described exemplary embodiment, the cartridge K that contains fresh developer that is to be supplied to the developing device G is described as an example of a developer container. However, the developer container is not limited to this, and may instead be, for example, a waste toner box that contains developer that is collected from the photoconductor cleaner CLp or the belt cleaner CLb. The present invention may be applied to a portion of, for example, a detachable developing device G or the like that serves as a container that contains developer therein and that is detachably attached to the transporting device body in the image forming apparatus.

(H03) In the above-described exemplary embodiment, the lock cancelling portions 58 are formed integrally with the inner shutter guides 57. However, the lock cancelling portions are not limited to this, and may instead be configured such that the lock cancelling portions do not serve as the inner shutter guides but as stoppers that prevent the inner shutter 59 from being detached, or such that the lock cancelling portions do not provide any function other than the lock cancelling function.

(H04) In the above-described exemplary embodiment, the outer shutter 67 is configured to move along an arc path over the outer peripheral surface of the cartridge body 51. However, the outer shutter 67 is not limited to this, and may instead be configured to move along a plane instead of an arc. In addition, although the outer shutter 67 is moved in a direction orthogonal to the direction in which the inner shutter 59 is moved, the moving direction of the outer shutter 67 is not limited to this. The moving direction of the outer shutter 67 may be changed arbitrarily, and may be set to a direction that is inclined relative to the front-back direction.

(H05) In the above-described exemplary embodiment, the structures of the inlet-shutter holder 21, the body engagement member 39, the cartridge engagement member 62, etc., are not limited to the above-described structures, and may be changed as appropriate in accordance with the design, usage, and other factors. For example, although the locking arms 33, the arms 39*b*, the insertion portions 62*b*, etc., are provided in pairs to be arranged at the left and right sides, these components may instead be provided at only one of the left and right sides.

(H06) In the above-described exemplary embodiment, the double-shutter structure including the inner shutter 59 and the outer shutter 67 is explained. However, the present invention is not limited to this, and a single-shutter structure may be used instead.

(H07) In the above-described exemplary embodiment, the pushing portion 13*b* is a mountain-shaped projection that projects rightward and has an eaves-shaped structure. However, the pushing portion 13*b* is not limited to this, and may be formed in an arbitrary shape, such as a trapezoidal shape or a semicircular shape. Although the pushing portion 13*b* preferably has an eaves-shaped structure and the through hole 13*d* is preferably formed, the pushing portion 13*b* may instead be formed such that no space is provided therebelow.

(H08) In the above-described exemplary embodiment, the area of the contact surface 13*c* may be set arbitrarily. Although the contact surface 13*c* is preferably provided, the contact surface 13*c* may be omitted.

(H09) In the above-described exemplary embodiment, the restricting projection 11*b* comes into contact with the stopper 63. However, the portion with which the restricting projection 11*b* comes into contact is not limited to the stopper 63, and may instead be any portion as long as the clearance may be reduced. Although the restricting projection 11*b* is preferably provided, the restricting projection 11*b* may be omitted.

(H010) In the above-described exemplary embodiment, the outer shutter 67 is locked by the locking lug 71 and the locking projection 64*a*. However, the lock mechanism is not limited to that described in the exemplary embodiment, and any known lock mechanism may be used. In addition, although the lock mechanism is preferably provided, the lock mechanism may be omitted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transporting device comprising:

a transporting device body including a transporting portion through which developer is transported, the transporting portion having an inlet that allows the developer to be supplied therethrough;

a developer container that is detachably supported on the transporting device body and includes a container portion and a cover member, the container portion containing developer and having an outlet that is connectable to the inlet and through which the developer is discharged from the container portion, and the cover member being movable between an uncovering position for uncovering the outlet and a covering position for covering the outlet in a moving direction that crosses an attachment direction in which the developer container is attached to the transporting device body;

a first contact portion supported by the cover member;

a guide portion that is provided on the transporting device body, that allows the first contact portion to pass therethrough, and that includes a passage portion and an inclined portion, the passage portion extending in the attachment direction, the inclined portion being connected to a downstream end of the passage portion in the attachment direction and inclined away from the outlet, the inclined portion contacting with the first contact portion and moving the cover member in the moving direction; and a second contact portion that is provided on the passage portion, that contacts with the first contact portion, and that moves the cover member toward the covering position when the first contact portion passes the second contact portion.

2. The developer transporting device according to claim 1, further comprising:

a receiving portion that is disposed adjacent to the second contact portion and that is capable of receiving an end portion of the first contact portion.

3. The developer transporting device according to claim 1, wherein an outer surface of the container portion is curved and the cover member is movable along the outer surface, wherein the first contact portion extends in a radial direction of the outer surface, and wherein the second contact portion includes a second contact surface that contacts with a first contact surface of the first contact portion, the first contact surface extending in the radial direction.

4. The developer transporting device according to claim 1, further comprising:

a restricting portion provided on the transporting device body, the restricting portion restricting a position of the developer container corresponding to the transporting device when the first contact portion contacts with the second contact portion.

5. The developer transporting device according to claim 4, wherein the restricting portion restricts the position of the developer container when the developer container is detached from the transporting device body.

6. The developer transporting device according to claim 4, wherein the restricting portion and the second contact portion tightens the cover member therebetween so that the cover member moves toward the covering position when the first contact portion contacts the second contact portion.

7. The developer transporting device according to claim 1, further comprising:

a first stopper portion provided on the cover member;

a second stopper portion provided on the developer container at a position corresponding to the first stopper portion when the cover member is at the covering position, the cover member being obstructed from moving to the uncovering position from the covering position when the second stopper portion contacts with, the first stopper portion; and an urging portion that urges the cover member in a direction that the first stopper portion and the second stopper portion contact with each other, wherein the cover member is supported to be movable in directions that the first and second stopper portions come into contact with and move away from each other.

8. The developer transporting device according to claim 7, wherein when the developer container is moved in the attachment direction, the inclined portion comes into contact with the first contact portion and moves the cover member in the direction that the first and second stopper portions move away from each other.

9. The developer transporting device according to claim 1, wherein the cover member includes a first cover member that is supported by the outlet and that is movable between an opening position for opening the outlet and a closing position for closing the outlet, and a second cover member that is supported outside the first cover member and that is movable between a position for exposing the first cover member and a position for covering the first cover member.

10. An image forming apparatus comprising:

an image carrier that rotates;

a developing device that forms a visible image by developing a latent image formed on a surface of the image carrier;

a transfer device that transfers the visible image from the surface of the image carrier to a medium;

a fixing device that fixes the visible image that has been transferred onto the medium; and the developer transporting device according to claim 1, the developer transporting device transporting the developer to the developing device.

* * * * *